US010865059B2

(12) United States Patent
Aoyama et al.

(10) Patent No.: US 10,865,059 B2
(45) Date of Patent: Dec. 15, 2020

(54) SHEET CONTAINER, SHEET CONVEYING DEVICE INCORPORATING THE SHEET CONTAINER, AND IMAGE FORMING APPARATUS INCORPORATING THE SHEET CONVEYING DEVICE

(71) Applicants: Jumpei Aoyama, Kanagawa (JP); Hirofumi Horita, Kanagawa (JP); Yuuki Shiga, Kanagawa (JP); Junpei Kamichi, Tokyo (JP); Hideto Higaki, Kanagawa (JP); Fumihiro Tsunoda, Kanagawa (JP)

(72) Inventors: Jumpei Aoyama, Kanagawa (JP); Hirofumi Horita, Kanagawa (JP); Yuuki Shiga, Kanagawa (JP); Junpei Kamichi, Tokyo (JP); Hideto Higaki, Kanagawa (JP); Fumihiro Tsunoda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 77 days.

(21) Appl. No.: 16/248,984

(22) Filed: Jan. 16, 2019

(65) Prior Publication Data

US 2019/0225438 A1 Jul. 25, 2019

(30) Foreign Application Priority Data

Jan. 24, 2018 (JP) ..... 2018-009980

(51) Int. Cl.
*B65H 1/12* (2006.01)
*B65H 1/04* (2006.01)
*B65H 1/26* (2006.01)

(52) U.S. Cl.
CPC ..... *B65H 1/12* (2013.01); *B65H 1/04* (2013.01); *B65H 1/266* (2013.01); (Continued)

(58) Field of Classification Search
CPC .... B65H 1/04; B65H 1/12; B65H 2405/1117; B65H 2405/1122
See application file for complete search history.

(56) References Cited

U.S. PATENT DOCUMENTS 5,758,250 A * 5/1998 Miki ..... B65H 1/20 271/160
8,417,174 B2 * 4/2013 Yamazaki ..... G03G 15/6511 399/393
2008/0179818 A1 * 7/2008 Hashimoto ..... B65H 1/266 271/145

FOREIGN PATENT DOCUMENTS

JP 6-080253 3/1994
JP 9-142674 6/1997

* cited by examiner

*Primary Examiner* — Howard J Sanders
(74) *Attorney, Agent, or Firm* — Harness, Dickey and Pierce, P.L.C.

(57) ABSTRACT

A sheet container includes a bottom plate, a regulating body, and a holding body. The bottom plate is disposed movable and has a bottom plate-side contact portion. The regulating body regulates a position of a trailing end of a sheet. The holding body has a holding body-side contact portion and to hold the regulating body. The bottom plate and the holding body have a gap between the bottom plate-side contact portion of the bottom plate and the holding body-side contact portion of the holding body in a state in which the bottom plate is not rotated. The bottom plate-side contact portion of the bottom plate and the holding body-side contact portion of the holding body contact with each other along with rotation of the bottom plate. The holding body moves to a downstream side in a sheet feeding direction in conjunction with the rotation of the bottom plate.

12 Claims, 18 Drawing Sheets

(52) U.S. Cl.
CPC ..... *B65H 2301/4222* (2013.01); *B65H 2403/5331* (2013.01); *B65H 2405/1117* (2013.01); *B65H 2405/1122* (2013.01)

SHEET CONTAINER, SHEET CONVEYING DEVICE INCORPORATING THE SHEET CONTAINER, AND IMAGE FORMING APPARATUS INCORPORATING THE SHEET CONVEYING DEVICE

CROSS-REFERENCE TO RELATED APPLICATIONS

This patent application is based on and claims priority pursuant to 35 U.S.C. § 119(a) to Japanese Patent Application No. 2018-009980, filed on Jan. 24, 2018, in the Japan Patent Office, the entire disclosure of which is incorporated by reference herein.

BACKGROUND

Technical Field

This disclosure relates to a sheet container, a sheet conveying device, and an image forming apparatus.

Background Art

A sheet container including a storage housing to store a sheet to be fed, a bottom plate that rotates such that a downstream end in a feeding direction moves up and down, and a holding member to hold a regulating member to regulate a position of an upstream end in the feeding direction of the sheet, and moving in the feeding direction in conjunction with the rotation of the bottom plate is known.

As a sheet container of this type, a configuration in which a hook portion of the bottom plate is hooked on a hole portion of the holding member (slide plate) to connect the holding member and the bottom plate, and the holding member moves in the feeding direction in conjunction with the rotation of the bottom plate is known. In this device, the hook portion is near the upstream end in the feeding direction of the bottom plate, and when the bottom plate rotates to raise the downstream end in the feeding direction, the hook portion moves to the downstream side in the feeding direction. Then, the holding member connected with the hook portion in the hole portion also moves to the downstream side in the feeding direction. The downstream side in the feeding direction of the sheet stored in the storage housing is raised as the downstream end in the feeding direction of the bottom plate rises, and the sheet pushed by the regulating member held by the holding member moves to the downstream side in the feeding direction as the holding member moves to the downstream side in the feeding direction.

SUMMARY

At least one aspect of this disclosure provides a sheet container including a bottom plate, a regulating body, and a holding body. The bottom plate is disposed movable and has a bottom plate-side contact portion. The regulating body regulates a position of a trailing end of a sheet. The holding body has a holding body-side contact portion and holds the regulating body. The bottom plate and the holding body has a gap between the bottom plate-side contact portion of the bottom plate and the holding body-side contact portion of the holding body in a state in which the bottom plate is not rotated. The bottom plate-side contact portion of the bottom plate and the holding body-side contact portion of the holding body come into contact with each other along with rotation of the bottom plate. The holding body moves to a downstream side in a sheet feeding direction in conjunction with the rotation of the bottom plate.

Further, at least one aspect of this disclosure provides a sheet conveying device including the above-described sheet container to contain a sheet, and a sheet feeding body to feed the sheet contained in the sheet container.

Further, at least one aspect of this disclosure provides an image forming apparatus including an image forming device to form an image on a sheet and the above-described sheet conveying device to convey the sheet toward the image forming device.

Further, at least one aspect of this disclosure provides a sheet container including a container housing, a bottom plate, a regulating body, a housing body, a biasing body, and an abutted body. The container housing contains a sheet. The bottom plate is disposed rotatable. The regulating body regulates a position of a trailing end of the sheet. The holding body holds the regulating body and to move to a downstream side in a sheet feeding direction in conjunction with rotation of the bottom plate. The biasing body biases the holding body to an upstream side in the sheet feeding direction with respect to the container housing. The abutted body against which the holding body abuts. The abutted body regulates the holding body to move to the upstream side in the sheet feeding direction. The holding body is biased by the biasing body and abuts against the abutted body in a state where the bottom plate does not rotate.

Further, at least one aspect of this disclosure provides a sheet conveying device including the above-described sheet container to contain a sheet, and a sheet feeding body to feed the sheet contained in the sheet container.

Further, at least one aspect of this disclosure provides an image forming apparatus including an image forming device to form an image on a sheet and the above-described sheet conveying device to convey the sheet toward the image forming device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1A:
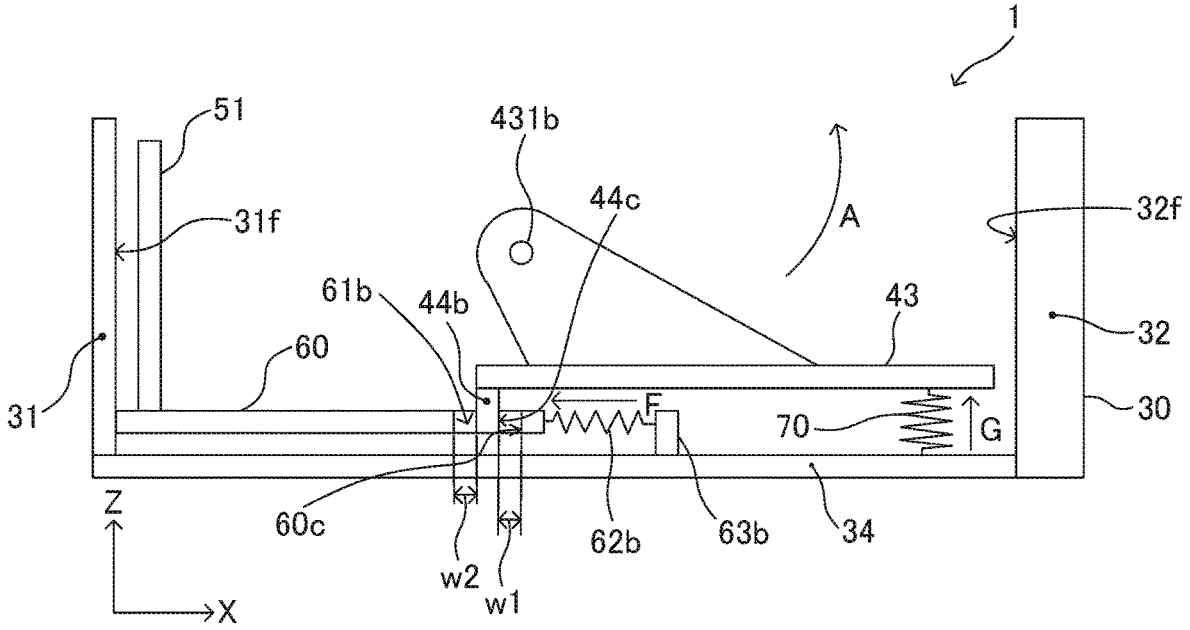
FIG. 1A is a side view illustrating a schematic configuration of a sheet tray according to an embodiment of this disclosure, with a downstream end of a bottom plate being lowered.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, as an embodiment of an image forming apparatus to which this disclosure is applied, an electrophotographic image forming apparatus such as a printer that forms an image by an electrophotographic method will be described with reference to the drawings.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

It is to be noted that identical parts are given identical reference numerals and redundant descriptions are summarized or omitted accordingly.

In the following description, the term "image forming apparatus" refers to an image forming apparatus that performs image formation by attaching developer or ink to a medium such as paper, OHP sheet, yarn, fiber, cloth, leather, metal, plastic, glass, wood, ceramics and the like. Further, it is to be noted that the term "image formation" indicates an action for providing (i.e., printing) not only an image including texts and figures on a recording medium but also an image not including such as patterns on a recording medium.

The term "sheet" of the present embodiment includes paper, coated paper, OHP sheet, label paper, film, cloth and the like. Further, the term "sheet" includes a resin sheet, a protective paper on the front and back faces, a metal sheet, an electronic circuit board material subject to metal foil plating such as a copper foil or electroplating, a special film, a plastic film, a prepreg, an electronic circuit substrate sheet, and the like. The prepreg is a sheet-like material in which carbon fiber or the like is previously impregnated with resin. As an example, the prepreg includes a sheet-like reinforced plastic molding material that is manufactured by, for example, impregnating a thermosetting resin, into which additives such as curative agent and coloring agent are mixed, in a fibrous reinforcing material such as a carbon fiber or a glass cloth, and then heating or drying to a semi-cured state.

It is to be noted that the term "sheet" is not limited to indicate a paper sheet but also includes a material which is called as a recording target medium, a recording medium, a recording sheet, or a recording paper, and is used to which the developer or ink is attracted. In addition, the term "sheet" is not limited to a flexible sheet but is applicable to a rigid plate-shaped sheet and a relatively thick sheet.

Further, in the following embodiments, size (dimension), material, shape, and relative positions used to describe each of the components and units are examples, and the scope of this disclosure is not limited thereto unless otherwise specified. In the present embodiment, an electrophotographic printer will be described as an example of an image forming apparatus, but an image forming apparatus to which this disclosure is applicable is not limited thereto. Specifically, the image forming apparatus in the present embodiment is applicable to any of a copier, facsimile machine, printer, printing machine, inkjet recording device, and a multifunctional apparatus including at least two functions of the copier, facsimile machine, printer, printing machine, and inkjet recording device. Further, the image forming apparatus according to the present embodiment may also include an electrophotographic copier provided with an image reading device.

Figure 2:
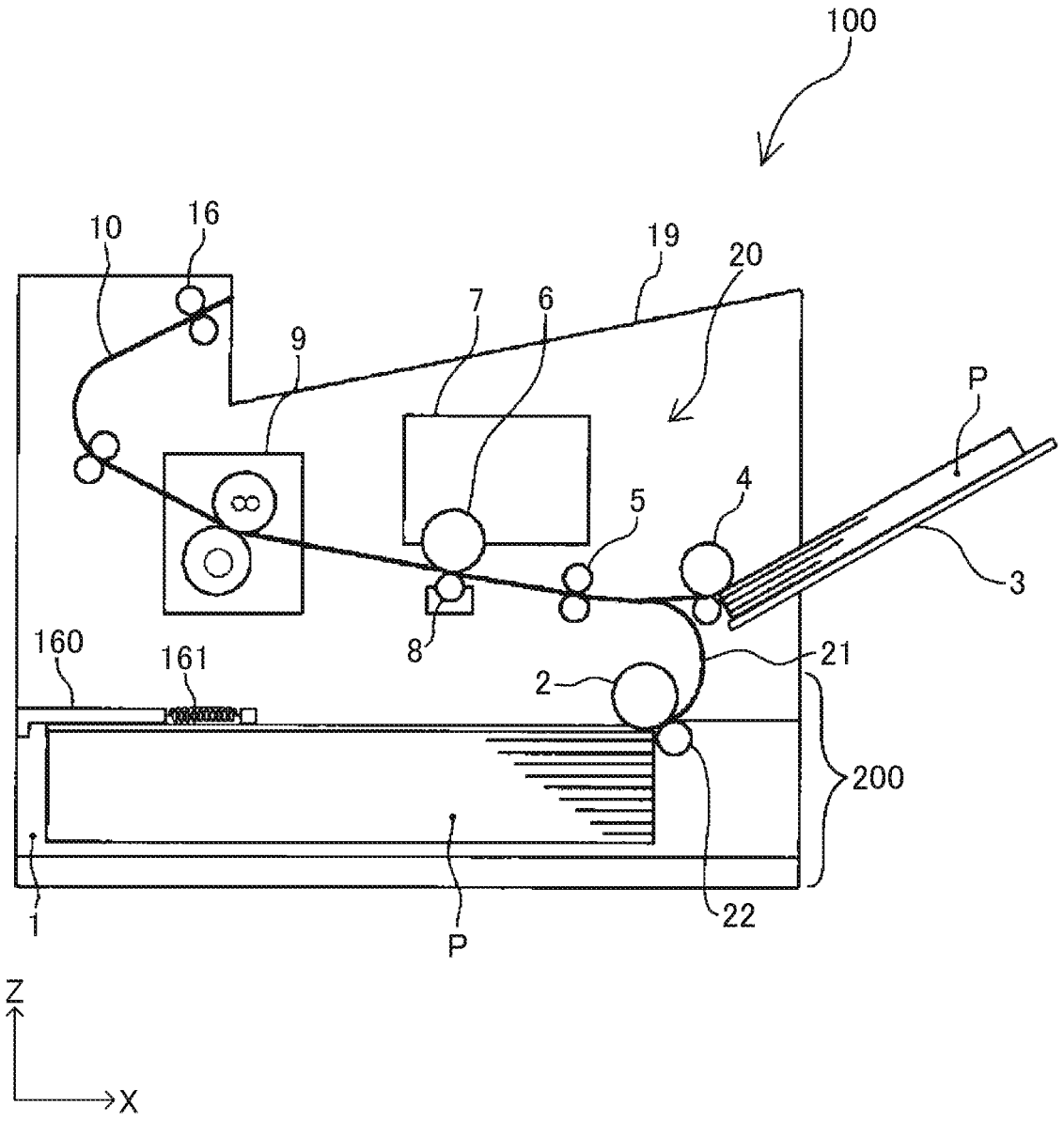
FIG. 2 is a diagram illustrating a schematic configuration of an image forming apparatus according to an embodiment of this disclosure.

Now, a description is given of a basic configuration of an image forming apparatus 100 according to an embodiment of this disclosure, with reference to FIG. 2.

FIG. 2 is a diagram illustrating a schematic configuration of the image forming apparatus 100 according to the present embodiment of this disclosure.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an electrophotographic printer that forms toner images on recording media by electrophotography.

As illustrated in FIG. 2, the image forming apparatus 100 includes a photoconductor 6, an image forming unit 7, a transfer device 8, and a fixing device 9. The photoconductor 6 functions as a latent image bearer. The image forming unit 7 forms a toner image on a surface of the photoconductor 6. The transfer device 8 transfers the toner image formed on the surface of the photoconductor 6 onto a recording medium P. The fixing device 9 fixes the toner image transferred onto the recording medium P to the recording medium P. The photoconductor 6, the image forming unit 7, the transfer device 8, and the fixing device 9 form an image forming device 20 that forms an image on the recording medium P.

The image forming apparatus 100 further includes a sheet feeding device 200 disposed below the image forming device 20. The sheet feeding device 200 includes a sheet tray 1, a sheet feed roller 2, and a sheet separation roller 22. The sheet tray 1 functions as a sheet container to store a bundle of recording media P. The sheet feed roller 2 functions as a sheet conveying body to apply a conveying force to the recording medium P stored in the sheet tray 1. The sheet separation roller 22 is disposed facing the sheet feed roller 2 and functions as a sheet separating body to separate an uppermost sheet from a subsequent sheet or subsequent sheets. The image forming apparatus 100 further includes a bypass sheet tray 3 and a bypass sheet feed roller 4 on the right side of the image forming device 20 in FIG. 2. A recording medium P is loaded on the bypass sheet tray 3 when feeding the recording medium P manually. The bypass sheet feed roller 4 applies a conveying force to the recording medium P loaded on the bypass sheet tray 3.

When the image forming apparatus 100 performs image formation, an exposure device included in the image forming unit 7 forms a latent image on a surface of the photoconductor 6, and a developing device also included in the image forming apparatus 100 develops the latent image formed on the surface of the photoconductor 6 into a visible toner image on the surface of the photoconductor 6.

When forming an image on the recording medium P stored in the sheet tray 1, a recording medium P to be conveyed one by one by the sheet feed roller 2 from the sheet tray 1 is conveyed via a sheet conveyance passage 21 to a position where the recording medium P contacts a pair of registration rollers 5.

When forming an image on the recording medium P loaded on the bypass sheet tray 3, a recording medium P to be conveyed one by one by the bypass sheet feed roller 4 from the bypass sheet tray 3 is conveyed to a position where the recording medium P contacts the pair of registration rollers 5.

Then, the pair of registration rollers 5 rotates in synchronization with movement of the toner image formed on the surface of the photoconductor 6 arriving a transfer position located facing the transfer device 8, so that the toner image formed on the surface of the photoconductor 6 is transferred onto the surface of the recording medium P at the transfer position. The recording medium P that has the toner image thereon is then conveyed to the fixing device 9 where the toner image on the surface of the recording medium P is fixed to the sheet P by application of heat and pressure. Thereafter, the recording medium P is discharged by a pair of sheet output rollers 16 to a sheet output tray 19 located outside an apparatus body of the image forming apparatus 100.

The sheet tray 1 is pulled out to the left side in a horizontal direction in FIG. 2, relative to the apparatus body of the image forming apparatus 100. By pulling out the sheet tray 1, a storing portion of the sheet tray 1 in which the recording medium P is stored is exposed, so that a user sets the recording medium P in the storing portion of the sheet tray 1.

Next, a description is given of the sheet tray 1 according to the present embodiment of this disclosure.

Figure 3A:
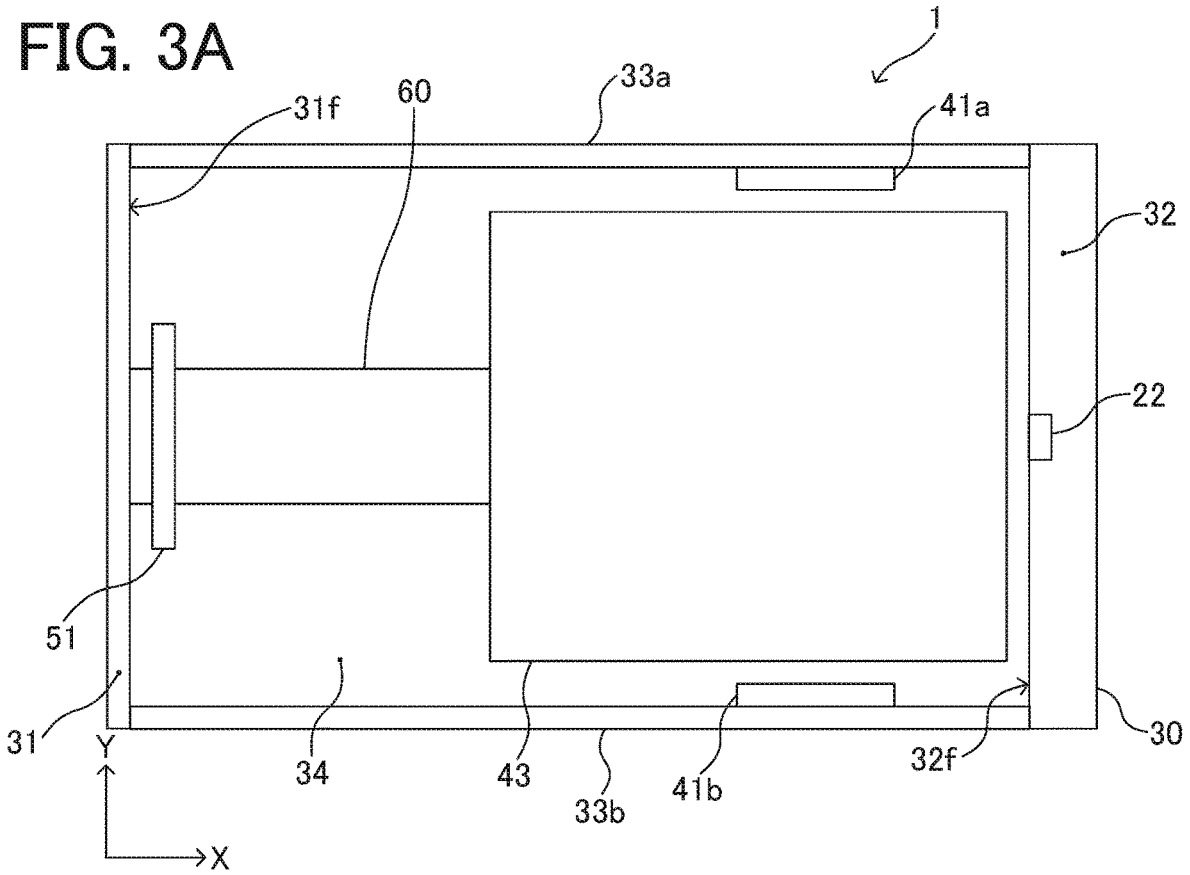
FIG. 3A is a top view illustrating the sheet tray with no recording medium set.
Figure 3B:
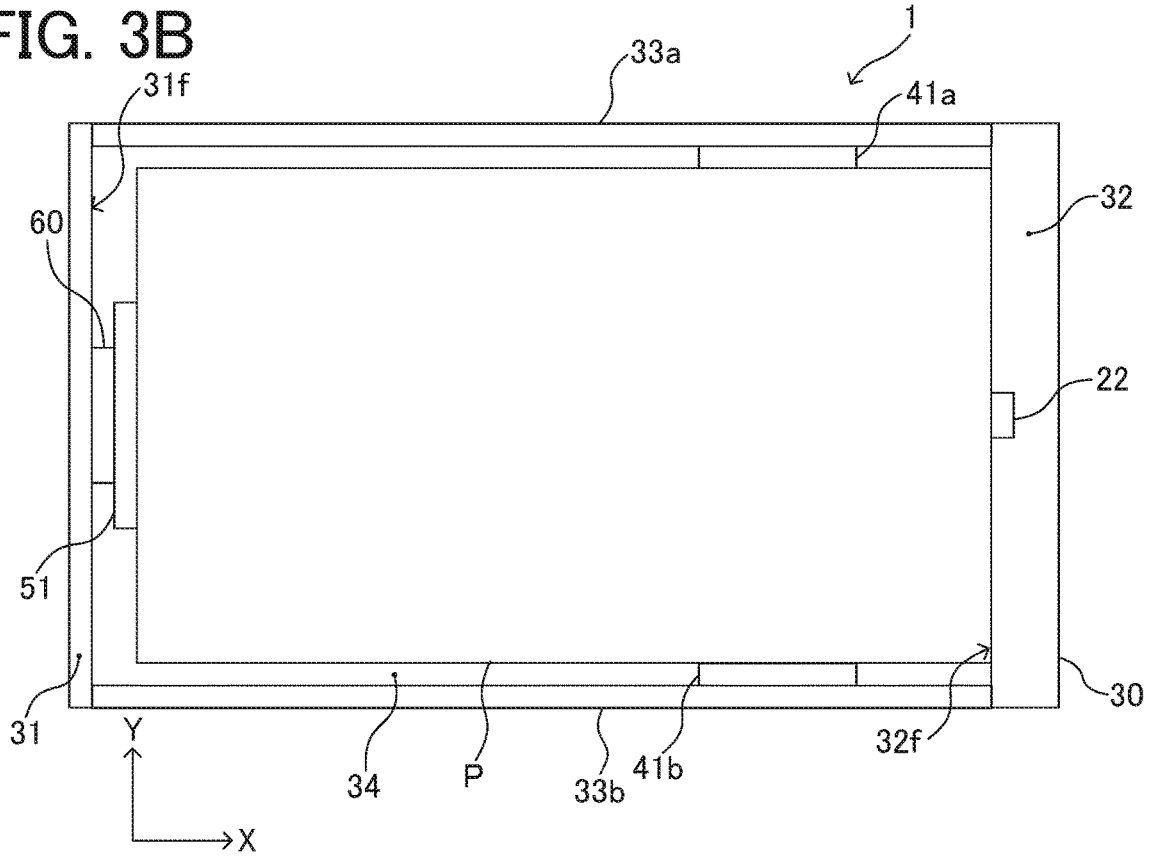
FIG. 3B is a top view illustrating the sheet tray with a recording medium or recording media set.

FIG. 3A is a top view illustrating the sheet tray 1 with no recording medium P set. FIG. 3B is a top view illustrating the sheet tray 1 with a recording medium P set.

The sheet tray 1 forms a storing portion to store the sheet P by a tray housing 30 having a rear wall 31, a front wall 32, side walls 33 (33*a* and 33*b*), and a lower surface 34. Further, as illustrated in FIG. 3B, the sheet tray 1 holds the sheet P in the tray housing 30 by a right side fence 41*a*, a left side fence 41*b*, an end fence 51, and the front wall 32. The sheet tray 1 has a bottom plate 43 to support a lower surface on a downstream side in a sheet feeding direction of the sheet P to be stored (a leading end side of the sheet), and having a downstream end in the sheet feeding direction move up and down. Furthermore, the sheet tray 1 includes a slider 60 including the end fence 51 and slidable in the sheet feeding direction (the right-left direction in FIGS. 3A and 3B) in conjunction with the up-down movement of the bottom plate 43.

The right side fence 41*a* and the left side fence 41*b* are movable in a width direction (the up-down direction in FIGS. 3A and 3B) with respect to the tray housing 30. The right side fence 41*a* and the left side fence 41*b* are movable in the width direction in accordance with the size of the sheet P set in the sheet tray 1, and can press both ends in the width direction of a bundle of the sheets P by being moved in accordance with the width of the sheets P by the user after setting the sheets P. Thereby, the right side fence 41*a* and the left side fence 41*b* can position the sheet P in the width direction in the tray housing 30.

The end fence 51 is movable in the sheet feeding direction with respect to the slider 60, and can press a trailing end of the bundle of the sheets P by being moved to abut against the trailing end of the sheets P by the user after setting the sheets P. The trailing end of the sheets P abuts against the end fence 51 and a leading end of the sheets P abuts against a front end wall surface 32*f* as a wall surface of the front wall 32 inside the storing portion, whereby the sheets P in the sheet feeding direction in the tray housing 30 can be positioned.

Figure 1B:
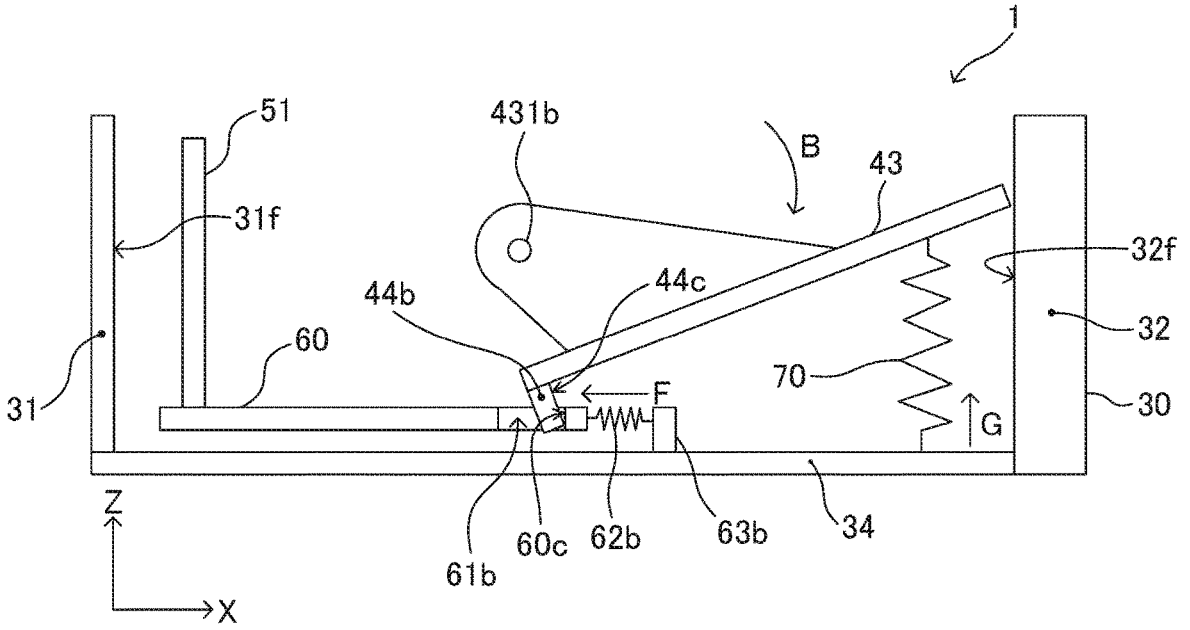
FIG. 1B is a side view illustrating a schematic configuration of the sheet tray according to an embodiment of this disclosure, with the downstream end of the bottom plate being lifted.

FIGS. 1A and 1B are schematic side views of the sheet tray 1. FIG. 1A is an explanatory view of a state in which the bottom plate 43 does not rotate, that is, a state in which a downstream end in the sheet feeding direction of the bottom plate 43 has completely lowered. Further, FIG. 1B is an explanatory view of a state in which the bottom plate 43 has rotated to rise a downstream end in the sheet feeding direction of the bottom plate 43, and the slider 60 has moved to the downstream side in the sheet feeding direction in conjunction with the rotation of the bottom plate 43. As illustrated in FIGS. 1A and 1B, the sheet tray 1 holds the bottom plate 43 to be rotatable about bottom plate rotation shafts 431*a* (see FIG. 4) and 431*b* with respect to the tray housing 30. Further, the sheet tray 1 includes bottom plate ascending springs 70 (that is, bottom plate ascending springs 70*a* and 70*b*) to bias a downstream end in the sheet feeding direction of the bottom plate 43 upward, as illustrated by the arrow "G" in FIGS. 1A and 1B. It is to be noted that the suffixes of the bottom plate ascending springs 70*a* and 70*b* are occasionally omitted and explained simply as "70" in the drawings when both the bottom plate ascending springs 70*a* and 70*b* are applicable to the configuration.

The downstream end in the sheet feeding direction of the bottom plate 43 is capable of ascending or descending, and the bottom plate 43 is inclined such that the downstream side is located upward as the downstream end in the sheet feeding direction ascends by a biasing force of the bottom plate ascending springs 70 (i.e., the bottom plate ascending springs 70*a* and 70*b*). In a case where the number of sheets P set in the sheet tray 1 is large, the downstream end in the sheet feeding direction of the bottom plate 43 descends against the biasing force of the bottom plate ascending spring 70 (i.e., the bottom plate ascending springs 70*a* and 70*b*) to be in a state close to FIG. 1A, and the inclination of the bottom plate 43 becomes gentle. When the number of set sheets P becomes small, the downstream end in the sheet feeding direction of the bottom plate 43 ascends by the biasing force of the bottom plate ascending springs 70 (i.e., the bottom plate ascending springs 70*a* and 70*b*) to be in the state where the bottom plate 43 is inclined, as illustrated in FIG. 1B. Thereby, a state in which a vicinity of a leading end on an upper surface of the sheet P is in contact with the sheet feed roller 2 can be maintained, and the sheet P can be sent to the next process regardless of the number of set sheets P.

A connecting claw 44 for being connected with the slider 60 is provided near an upstream end in the sheet feeding direction of the bottom plate 43, and connecting hole 61*a* and 61*b* into which the connecting claw 44 is formed in the slider 60. Further, as illustrated in FIGS. 1A and 1B, the connecting claw 44 has, on its surface, a claw-side contact portion 44*c* as a bottom plate-side contact portion to come into contact with the slider 60. Further, the slider 60 has, on a surface of an edge forming the connecting holes 61*a* and 61*b*, a slider-side contact portion 60*c* as a holding body-side contact portion to come into contact with the connecting claw 44. The sheet tray 1 includes spring abutting portions 63*a* and 63*b* on the lower surface 34 of the tray housing 30, and slider biasing springs 62 (that is, slider biasing springs 62*a* and 62*b*) to bias the slider 60 toward the upstream side in the sheet feeding direction (the arrow "F" direction in FIGS. 1A and 1B) with respect to the spring abutting portions 63*a* and 63*b*.

When the sheet tray 1 is drawn out with respect to the apparatus body of the image forming apparatus 100, the downstream end in the sheet feeding direction of the bottom plate 43 descends by a bottom plate descending mechanism to be described in detail, and the position of the downstream end in the sheet feeding direction is secured in the state illustrated in FIG. 1A by a bottom plate securing mechanism to be described in detail. In the state illustrated in FIG. 1A, the slider-side contact portion 60*c* as a downstream edge in the sheet feeding direction of the connecting holes 61*a* (see FIG. 4) and 61*b* and the claw-side contact portion 44*c* of the connecting claw 44 are not in contact, and form a downstream gap w1. Further, an upstream edge in the sheet feeding direction of the connecting holes 61*a* (see FIG. 4) and 61*b* and the connecting claw 44 are not in contact, and form an upstream gap w2.

In the state illustrated in FIG. 1A, an upstream end in the sheet feeding direction of the slider 60 biased to the upstream side in the sheet feeding direction by the slider biasing springs 62 (i.e., the slider biasing springs 62*a* and 62*b*) abuts against a rear end wall surface 31*f* as a wall surface of the rear wall 31 inside the storing portion. Thereby, the slider 60 slidable in the sheet feeding direction relative to the tray housing 30 is positioned relative to the tray housing 30.

In the state illustrated in FIG. 1A, the bundle of sheets P is stored in the sheet tray 1, and a front portion of the bundle of sheets P is placed on the bottom plate 43 and a trailing end of the bundle of sheets P is brought to abut against the end fence 51 to align the position of the sheets P. When the sheet tray 1 is inserted in the apparatus body of the image forming apparatus 100 after the sheets P are placed, securement of the position of the bottom plate 43 by the bottom plate securing mechanism is released. When the securement is released, the bottom plate 43 rotates in the arrow "A" direction in FIG. 1A about the bottom plate rotation shafts 431*a* (see FIG. 4) and 431*b* up to a position where an upper surface of an uppermost sheet P of the placed bundle of sheets P comes into contact with the sheet feed roller 2 to push up the sheets P by the biasing force of the bottom plate ascending springs 70 (i.e., the bottom plate ascending springs 70*a* and 70*b*). When the sheet feed roller 2 is rotated in the state where the upper surface of the sheet P is in contact with the sheet feed roller 2, the sheets P are sequentially fed one by one to the image forming device 20.

When the bottom plate 43 rotates in the arrow "A" direction from the state illustrated in FIG. 1A, the connecting claw 44 moves to the downstream side in the sheet feeding direction. However, since there is the downstream gap w1, the slider 60 does not move together with the bottom plate 43 in the beginning of the rotation, and the position of the end fence 51 relative to the tray housing 30 is unchanged. The bottom plate 43 rotates in the arrow "A" direction from the state illustrated in FIG. 1A, the claw-side contact portion 44*c* comes into contact with the slider-side contact portion 60*c*, and the downstream gap w1 is gone. Then, when the bottom plate 43 further rotates, the connecting claw 44 moving to the upstream side in the sheet feeding direction attracts the slider 60 to the downstream side in the sheet feeding direction. The connecting claw 44 attracts the slider 60 in this manner, so that the slider 60 moves to the downstream side in the sheet feeding direction against the biasing force of the slider biasing springs 62.

In the state where the claw-side contact portion 44*c* is in contact with the slider-side contact portion 60*c*, the slider-side contact portion 60*c* in the slider 60 biased to the upstream side in the sheet feeding direction by the slider biasing spring 62 abuts against the claw-side contact portion 44*c* of the connecting claw 44. Thereby, the slider 60 slidable in the sheet feeding direction relative to the tray housing 30 is positioned relative to the tray housing 30. Then, when the bottom plate 43 rotates in the arrow "A" direction in FIG. 1A, the slider 60 moves to the downstream side in the sheet feeding direction, and when the bottom plate 43 rotates in the arrow "B" direction in FIG. 1B, the slider 60 moves to the upstream side in the sheet feeding direction. In the state where the claw-side contact portion 44*c* of the connecting claw 44 is in contact with the slider-side contact portion 60*c* of the slider 60, the slider 60 slides along the sheet feeding direction in conjunction with the up-down movement of the bottom plate 43.

When the bottom plate 43 rotates in the arrow "B" direction from the state illustrated in FIG. 1B, the upstream end in the sheet feeding direction of the slider 60 abuts against the rear end wall surface 31*f* before the downstream end in the sheet feeding direction of the bottom plate 43 completely lowers. When the bottom plate 43 further rotates in the arrow "B" direction, the claw-side contact portion 44*c* of the connecting claw 44 separates from the slider-side contact portion 60*c* to form the downstream gap w1. Then, the downstream end in the sheet feeding direction of the bottom plate 43 has completely lowered (the state where the bottom plate 43 does not rotate), as illustrated in FIG. 1A.

In a case of a configuration in which the position of the end fence 51 is unchanged even if the bottom plate 43 rotates, the distance from the end fence 51 to an upstream end in the sheet feeding direction of the bottom plate 43 becomes large when an upstream end in the sheet feeding direction of the bottom plate 43 moves to the downstream side in the sheet feeding direction with the rotation. In such a configuration, a sum of the length from the downstream end to the upstream end in the sheet feeding direction of the bottom plate 43 and the length from the end fence 51 to the upstream end in the sheet feeding direction of the bottom plate 43 in the sheet feeding direction becomes long with the rotation of the bottom plate 43. Meanwhile, the length of the sheet P, the upstream end in the sheet feeding direction of the sheet P abutting against the end fence 51, is constant. Therefore, the position of the downstream end in the sheet feeding direction of the sheet P (the leading end of the sheet P) relative to the downstream end in the sheet feeding direction of the bottom plate 43 moves to the upstream side in the sheet feeding direction by the rotation of the bottom plate 43 where the downstream end in the sheet feeding direction rises. When the leading end of the sheet P moves to the upstream side in the sheet feeding direction with respect to the downstream end in the sheet feeding direction of the bottom plate 43, the upper surface of the sheet P separates from the sheet feed roller 2, and sheet feeding failure may occur where the sheet P cannot be fed even if the sheet feed roller 2 rotates.

In contrast, in the configuration in which the slider 60 moves in the sheet feeding direction in conjunction with the movement in the sheet feeding direction of the upstream end in the sheet feeding direction of the bottom plate 43 with the rotation, as in the sheet tray 1 of the present embodiment, variation of the position of the leading end of the sheet P relative to the downstream end in the sheet feeding direction of the bottom plate 43 can be suppressed. Therefore, even if the bottom plate 43 rotates to raise the downstream end in the sheet feeding direction, separation of the upper surface of the sheet P from the sheet feed roller 2 can be prevented, and sheet feeding performance can be maintained.

However, in the conventional sheet tray in which the slider slides in conjunction with the rotation of the bottom plate, the sheet is sometimes bent in a stretched state between the end fence and the front end wall surface of the tray housing in the middle of rising of the downstream end in the sheet feeding direction of the bottom plate. If the sheet pushed up by the bottom plate is bent to protrude upward, the leading end of the sheet abutting against the front end wall surface slides downward along the front end wall surface, and the sheet enters a gap between the downstream end in the sheet feeding direction of the bottom plate and the front end wall surface, resulting in the feeding failure. Further, if the sheet pushed up by the bottom plate is bent to protrude downward, the bottom plate is pushed down by the bending, and the sheet cannot rise as expected and separates from the sheet feed roller, resulting in the feeding failure.

It has been found that the problem that the sheet is caught between the end fence and the front end wall surface occurs in a configuration in which the sliders slide in conjunction with the rotation of the bottom plate as soon as the bottom plate that has completely lowered rotates. This is considered to be due to the following reasons.

That is, when the bottom plate rotates to raise the downstream end in the sheet feeding direction of the bottom plate, the downstream end in the sheet feeding direction of the bottom plate does not rise directly upward, and rises along an arc about the bottom plate rotation shaft. At this time, in the configuration in which the bottom plate rotation shaft is located above the bottom plate in the state where the bottom plate completely lowers (the state where the bottom plate does not rotate), as in the sheet tray of the embodiment of this disclosure or a typical sheet tray, the downstream end in the sheet feeding direction of the bottom plate rises while moving to the downstream side in the sheet feeding direction. Therefore, the distance from the downstream end in the sheet feeding direction of the bottom plate to the front end wall surface in the sheet feeding direction is narrowed, and the distance from the end fence held by the slider that slides in conjunction with the bottom plate to the front end wall surface is narrowed. When setting the sheet in the sheet tray, the downstream end in the sheet feeding direction of the sheet is brought to abut against the front end wall surface and the upstream end in the sheet feeding direction is brought to abut against the end fence. Therefore, if the distance from the end fence to the front end wall surface is narrowed, this distance becomes shorter than the length in the sheet feeding direction of the sheet. As a result, it is considered that the sheet is caught between the end fence and the front end wall surface.

In a configuration in which a moving range in the up-down direction of the downstream end in the sheet feeding direction of the bottom plate is narrow, such as a configuration in which the number of storable sheets is small, a moving amount of the end fence to the downstream side in the sheet feeding direction when the bottom plate rotates is also small. Therefore, a narrowed amount of the distance from the end fence to the front end wall surface is small, and even when the sheet is stretched between the end fence and the front end wall surface, the stretching force is weak and impedance of rise of the downstream end in the sheet feeding direction of the bottom plate by the stretching force of the sheet is less likely to occur. If the downstream end in the sheet feeding direction of the bottom plate can be raised, the downstream end in the sheet feeding direction of the sheet supported by the bottom plate can be raised to a feedable position by the sheet feed roller, and the sheet can be fed. In contrast, in a configuration in which the moving range in the up-down direction of the downstream end in the sheet feeding direction of the bottom plate is wide, such as a configuration in which the number of storable sheets is large, the moving amount of the end fence to the downstream side in the sheet feeding direction when the bottom plate rotates is also large. Therefore, the narrowing amount of the distance from the end fence to the front end wall surface becomes large, and the stretching force when the sheet is stretched between the end fence and the front end wall surface becomes strong. When the bottom plate cannot push up the downstream side in the sheet feeding direction of the sheet due to the strong stretching force of the sheet, the bottom plate cannot raise the downstream end in the sheet feeding direction of the sheet to the feedable position by the sheet feed roller, and the sheet feeding failure may occur.

In the sheet tray 1 of the present embodiment, the downstream gap w1 is formed between the slider-side contact portion 60*c* of the slider 60 and the claw-side contact portion 44*c* of the connecting claw 44 in the state where the downstream end in the sheet feeding direction of the bottom plate 43 has completely lowered, as illustrated in FIG. 1A. That is, the downstream gap w1 is formed at a position on a downstream side in the sheet feeding direction with respect to the claw-side contact portion 44*c* and on an upstream side in the sheet feeding direction with respect to the slider-side contact portion 60*c*. Thereby, even when the bottom plate 43 rotates to raise the downstream end in the sheet feeding direction and the connecting claw 44 moves to the downstream side in the sheet feeding direction, the slider 60 does not move until the claw-side contact portion 44*c* comes into contact with the slider-side contact portion 60*c*. Therefore, the end fence 51 held by the slider 60 does not move, and the distance from the end fence 51 to the front end wall surface 32*f* can be prevented from being shorter than the length in the sheet feeding direction of the sheet P. Then, the sheet P can be prevented from being caught between the end fence 51 and the front end wall surface 32*f*.

When the bottom plate 43 further rotates and the connecting claw 44 moves by the downstream gap w1, the claw-side contact portion 44*c* and the slider-side contact portion 60*c* come into contact with each other. Thereafter, the claw-side contact portion 44*c* of the connecting claw 44 pushes the slider-side contact portion 60*c* of the slider 60 to the downstream side in the sheet feeding direction, and the slider 60 moves to the downstream side in the sheet feeding direction in conjunction with the rotation of the bottom plate 43. Therefore, the variation of the position of the leading end of the sheet P relative to the downstream end in the sheet feeding direction of the bottom plate 43 can be suppressed, and even when the bottom plate 43 rotates to raise the downstream end in the sheet feeding direction, the upper surface of the sheet P can be prevented from separating from the sheet feed roller 2, and the sheet feeding performance can be maintained.

If the downstream gap w1 is too narrow, a rotation amount of the bottom plate 43 from when the bottom plate 43 begins to rotate to raise the downstream end in the sheet feeding direction to when the slider 60 begins to rotate in conjunction with the rotation becomes small, and the sheet P cannot be prevented from being caught between the end fence 51 and the front end wall surface 32*f*. Further, if the downstream gap w1 is too wide, the rotation amount of the bottom plate 43 from when the bottom plate 43 begins to rotate to raise the downstream end in the sheet feeding direction to when the slider 60 begins to rotate in conjunction with the rotation becomes large. As a result, the leading end of the sheet P is located on the upstream side in the sheet feeding direction with respect to the downstream end in the sheet feeding direction of the bottom plate 43, and the sheet feeding failure cannot be prevented.

The downstream gap w1 in the state where the downstream end in the sheet feeding direction of the bottom plate 43 has completely lowered illustrated in FIG. 1A can be appropriately set within a range in which the above problem is preventable, and desirably falls within a range from 0.5 [mm] to 2.0 [mm]. Further, the downstream gap w1 more desirably falls within a range from 1.0 [mm] to 2.0 [mm], in consideration of an assembly error of about 0.5 [mm]. In the present embodiment, the downstream gap w1 illustrated in FIG. 1A is set to 1.0 [mm]. Further, the upstream gap w2 in the state where the downstream end in the sheet feeding direction of the bottom plate 43 has completely lowered desirably falls within a range from 0.5 [mm] to 2.0 [mm], and more desirably falls within a range from 1.0 [mm] to 2.0 [mm].

The sheet tray 1 includes the slider biasing spring 62 as a biasing body to bias the slider 60 to the upstream side in the sheet feeding direction with respect to the tray housing 30, as illustrated in FIGS. 1A and 1B. A configuration including a "tension spring" to bias a slide plate holding a regulating body to regulate the position of an upstream end in the feeding direction of the sheet to the downstream side in the feeding direction with respect to the housing to store the sheet is known. In this configuration, a force toward the upstream side in the sheet feeding direction acts on the regulating body. In a case where this force is larger than a biasing force of this "tension spring", the position of the regulating body relative to the housing to store the sheet varies, and the position of the sheet with the end regulated by the regulating body also becomes unstable.

In the sheet tray 1 of the present embodiment, the slider biasing spring 62 biases the slider 60 to the upstream side in the sheet feeding direction. Then, the slider 60 is positioned in the sheet feeding direction in either the state where the upstream end in the sheet feeding direction of the slider 60 abuts against the rear end wall surface 31*f* or the state where the slider-side contact portion 60*c* of the slider 60 abuts against the claw-side contact portion 44*c* of the connecting claw 44. In this configuration, even if a force toward the upstream side in the feeding direction acts on the end fence 51 as a regulating body, variation of the position of the end fence 51 relative to the tray housing 30 can be prevented because the slider 60 abuts against the rear end wall surface 31*f* or the connecting claw 44. Therefore, the position of the sheet P with the end regulated by the end fence 51 in the tray housing 30 is also stabilized.

The sheet tray 1 includes the rear wall 31 that is an abutted body against which the slider 60 abuts and to regulate movement to the upstream side in the sheet feeding direction of the slider 60. Then, when the bottom plate 43 rotates to lower the downstream end in the sheet feeding direction in the state where the slider-side contact portion 60*c* of the slider 60 is in contact with the claw-side contact portion 44*c* of the connecting claw 44, the slider 60 abuts against the rear wall 31 before the downstream end in the sheet feeding direction of the bottom plate 43 completely lowers. Thereby, the movement to the upstream side in the sheet feeding direction of the slider 60 is regulated, and the slider-side contact portion 60*c* cannot move to the upstream side in the sheet feeding direction. Thereafter, when the bottom plate 43 further rotates to lower the downstream end in the sheet feeding direction, the connecting claw 44 moves to the upstream side in the sheet feeding direction, and the downstream gap w1 is formed between the claw-side contact portion 44*c* of the connecting claw 44 and the slider-side contact portion 60*c*. With such a configuration, the configuration in which the downstream gap w1 is formed in the state where the downstream end in the sheet feeding direction of the bottom plate 43 has completely lowered (the state where the bottom plate 43 does not rotate) can be implemented.

In the present embodiment, the abutted body against which the slider 60 abuts before the downstream end in the sheet feeding direction of the bottom plate 43 completely lowers is the rear wall 31. However, a member against which the slider 60 abuts may be provided as the abutted body separately from the rear wall 31. However, with the configuration in which the abutted body is the rear wall 31, reduction of the number of parts and downsizing of the apparatus can be achieved as compared with the configuration separately provided with the member against which the slider 60 abuts.

The sheet tray 1 includes the slider biasing spring 62 to bias the slider 60 to the upstream side in the sheet feeding direction with respect to the tray housing 30, and the rear wall 31 as the abutted body against which the slider 60 abuts and to regulate the movement to the upstream side in the sheet feeding direction of the slider 60. Then, in the state where the downstream end in the sheet feeding direction of the bottom plate 43 has completely lowered (the state where the bottom plate 43 does not rotate), as illustrated in FIG. 1A, the slider 60 biased by the slider biasing spring 62 abuts against the rear wall 31. In this configuration, the position of the slider 60 is more stable when the slider 60 abuts against the rear wall 31 than a state where a part of the slider 60 abuts against the connecting claw 44 as a part of the rotatable bottom plate 43. Therefore, when setting the sheet P, the position of the end fence 51 held by the slider 60 is stable and the sheet P with the position of the upstream end in the sheet feeding direction regulated by the end fence 51 can be easily set to the sheet tray 1.

Figure 4:
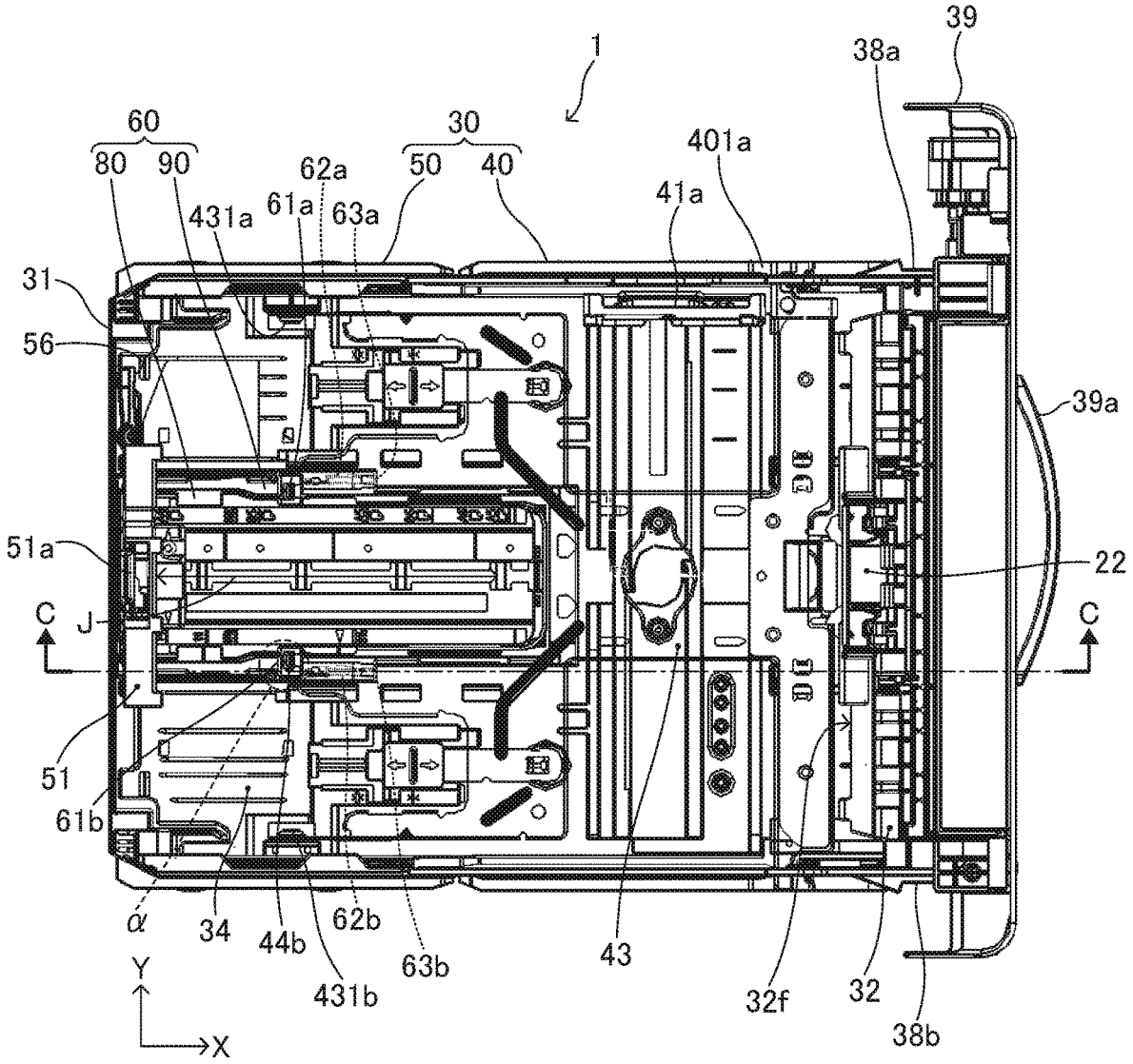
FIG. 4 is a top view illustrating the sheet tray in a non-extended state.

In the sheet tray 1 of the present embodiment, the length in the sheet feeding direction (X-axis direction) can be changed in two stages of a non-extended state and an extended state. FIG. 4 is a top view of the sheet tray 1 in the non-extended state, and FIG. 5 is a top view of the sheet tray 1 in the extended state.

Figure 5:
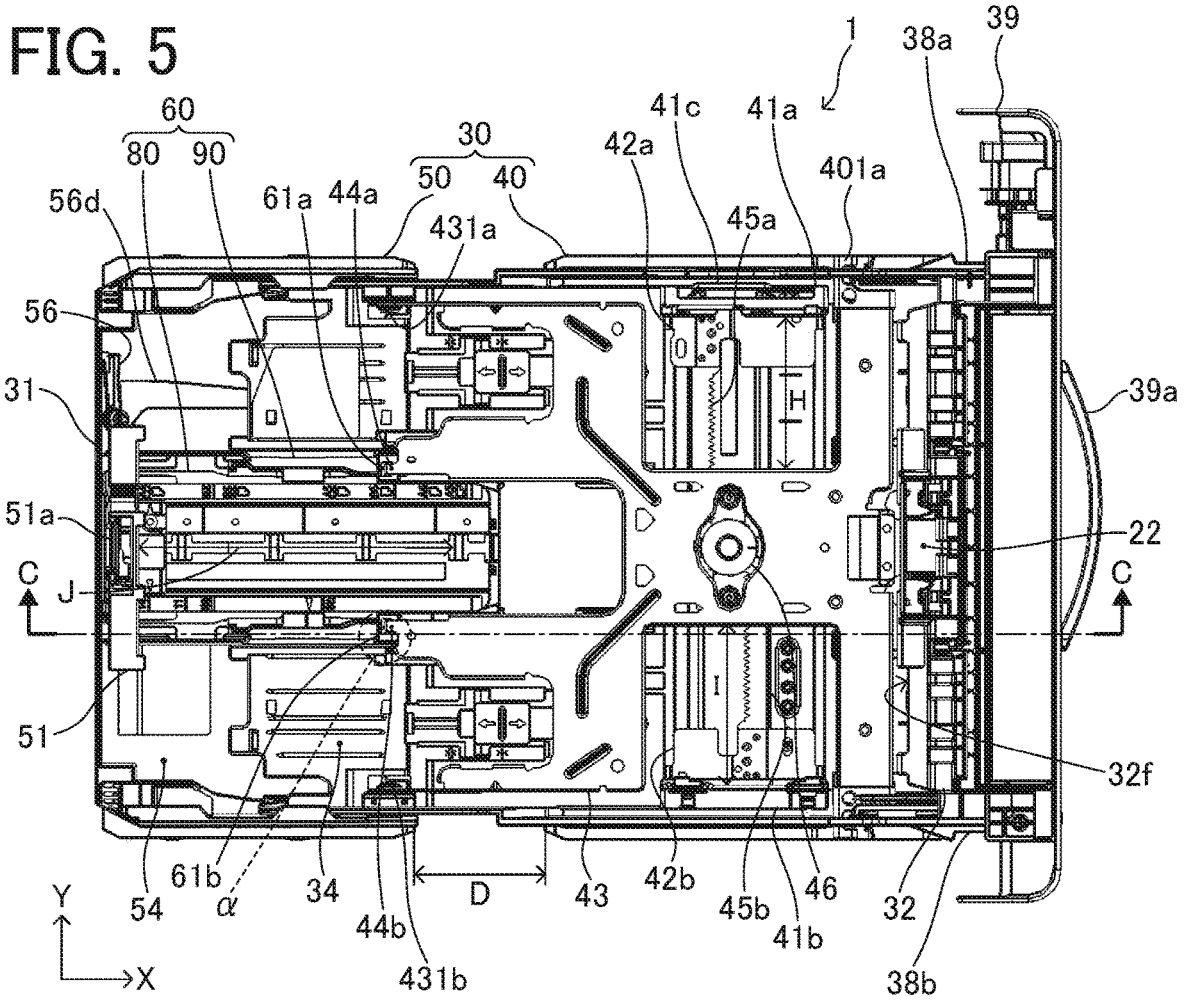
FIG. 5 is a top view illustrating the sheet tray in an extended state.

As illustrated in FIG. 5, the sheet tray 1 includes side fence supports 42 (that is, side fence supports 42*a* and 42*b*), a right rack gear 45*a*, a left rack gear 45*b*, and a side fence interlocking gear 46, as a mechanism to cause the two side fences, which are the right side fence 41*a* and the left side fence 41*b*, to work together. The right side fence 41*a* and the left side fence 41*b* are respectively secured to the right rack gear 45*a* and the left rack gear 45*b* by the side fence supports 42 (that is, side fence supports 42*a* and 42*b*).

Between the right side fence 41*a* and the left side fence 41*b*, the right side fence 41*a* is movable with respect to the tray housing 30 within a range indicated by the arrow "H" in FIG. 5, and the left side fence 41*b* is movable with respect to the tray housing 30 within a range indicated by the arrow "I" in FIG. 5. When a side securement release lever 41*c* included in the right side fence 41*a* is moved inward in the width direction (downward in FIG. 5), the right side fence 41*a* becomes movable in the width direction with respect to the tray housing 30. When the right side fence 41*a* is moved inward in the width direction (downward in FIG. 5), the right rack gear 45*a* moves inward in the width direction (downward in FIG. 5) and the side fence interlocking gear 46 rotates counterclockwise in FIG. 5. Thereby, the left rack gear 45*b* moves inward in the width direction (upward in FIG. 5), and the left side fence 41*b* moves inward in the width direction (upward in FIG. 5) in conjunction with the movement of the right side fence 41*a*.

FIG. 4 illustrates a state in which the left side fence 41*b*, the side fence supports 42 (i.e., the side fence supports 42*a* and 42*b*), the right rack gear 45*a* and the left rack gear 45*b*, and the side fence interlocking gear 46 are removed. Further, the end fence 51 is movable with respect to the slider 60 within a range indicated by the arrow "J" in FIGS. 4 and 5.

Figure 6:
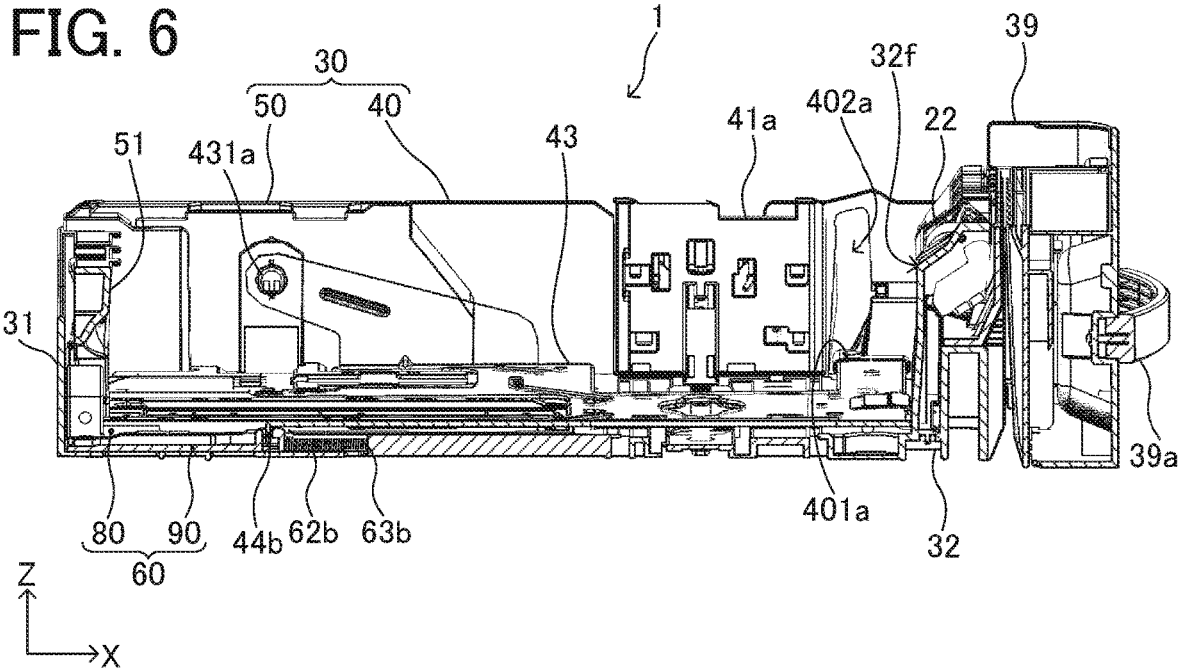
FIG. 6 is a perspective cross-sectional view illustrating the sheet tray in a non-extended state, as viewed from slightly above.
Figure 7:
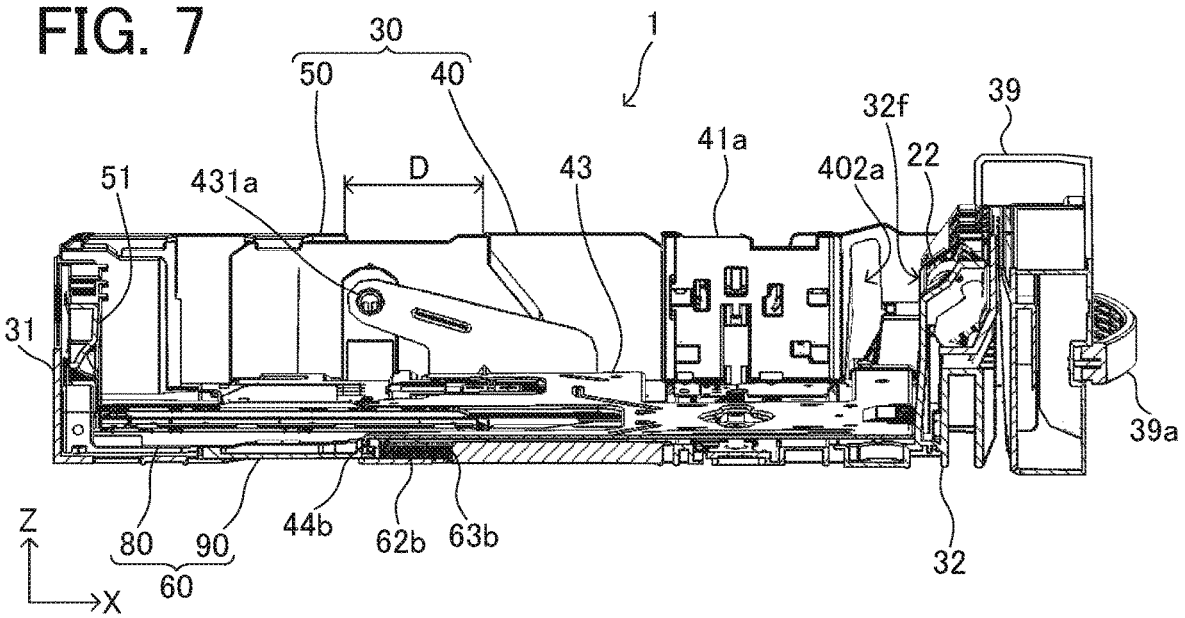
FIG. 7 is a perspective cross-sectional view illustrating the sheet tray in an extended state, as viewed from the same angle as FIG. 6.
Figure 8:
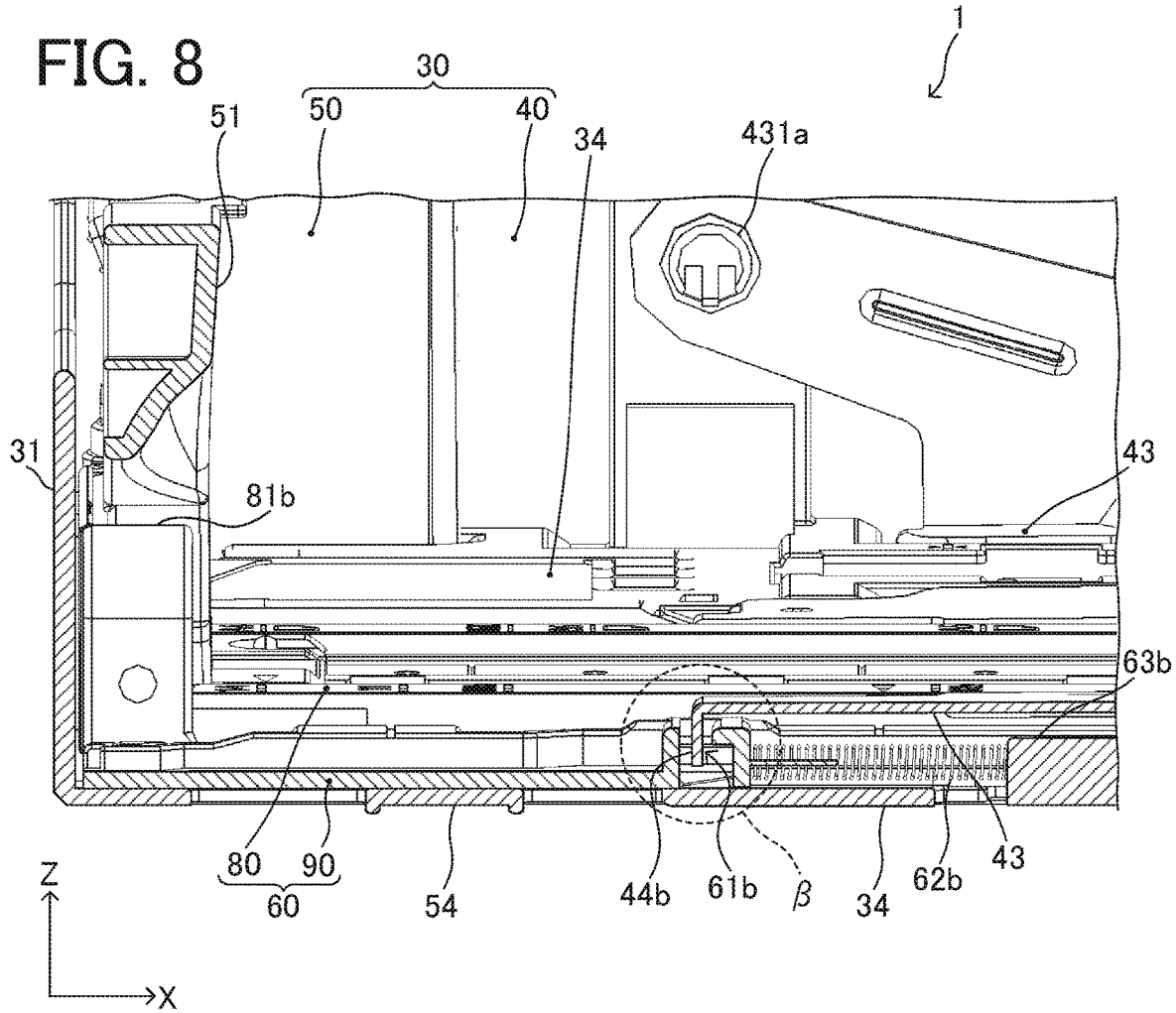
FIG. 8 is a perspective cross-sectional view illustrating the sheet tray of FIG. 6, with a slider biasing spring in a non-extended state being enlarged.
Figure 9:
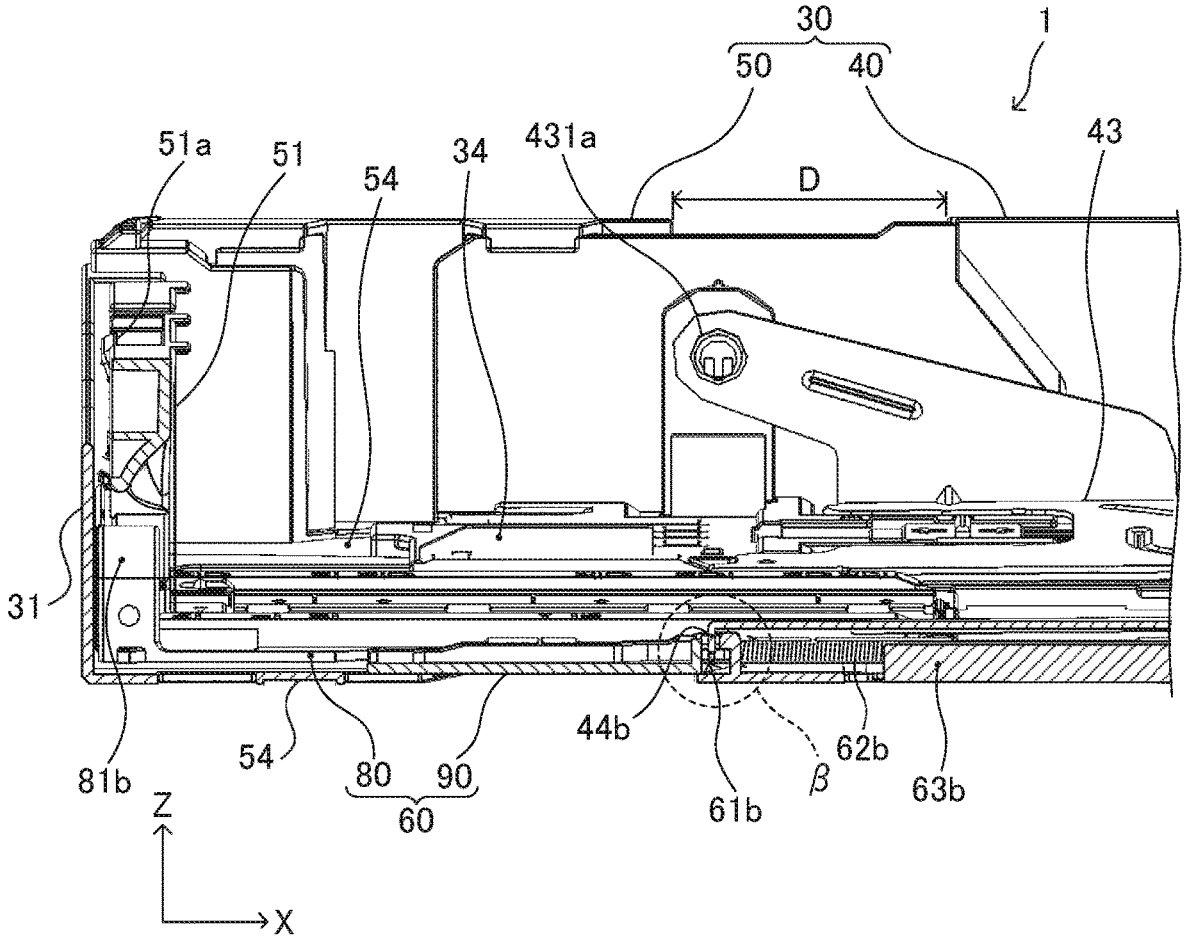
FIG. 9 is a perspective cross-sectional view illustrating the sheet tray of FIG. 7, with the slider biasing spring in an extended state being enlarged.

FIG. 6 is a perspective cross-sectional view of the sheet tray 1 in the non-extended state as viewed from a slightly higher position than the side (X-Z plane), and is a cross section taken along line C-C in FIG. 4. FIG. 7 is a perspective cross-sectional view of the sheet tray 1 in the extended state as viewed from the same angle and the same cross section as FIG. 6. FIG. 8 is an enlarged perspective cross-sectional view of a vicinity of the slider biasing spring 62 of the sheet tray 1 in the non-extended state illustrated in FIG. 6, and FIG. 9 is an enlarged perspective cross-sectional view of a vicinity of the slider biasing spring 62 of the sheet tray 1 in the extended state illustrated in FIG. 7. FIGS. 4 to 9 illustrate the state where the downstream end in the sheet feeding direction of the bottom plate 43 has completely lowered.

The tray housing 30 forming the storing portion to store the sheet P of the sheet tray 1 includes a front housing 40 and a rear housing 50. When an extension lever 56 provided near the trailing end of the sheet tray 1 is operated, the rear housing 50 becomes movable in a direction parallel to the sheet feeding direction with respect to the front housing 40. The rear housing 50 in which the end fence 51 is arranged is moved in a direction away from the front housing 40 (the left direction in FIGS. 4 to 9) by operating the extension lever 56. With the movement, the non-extended state illustrated in FIGS. 4, 6, and 8 can be transitioned to the extended state illustrated in FIGS. 5, 7, and 9, which is longer in the sheet feeding direction than the non-extended state.

A maximum loading size in the sheet tray 1 in the non-extended state illustrated in FIGS. 4, 6, and 8 is A4 size, and a maximum loading size in the sheet tray 1 in the extended state illustrated in FIGS. 5, 7, and 9 is legal size. The rear housing 50 is moved to the upstream side in the sheet feeding direction (leftward in FIGS. 4, 6, and 8) with respect to the front housing 40 by operating the extension lever 56, whereby the sheet tray 1 can be extended by the length illustrated by the arrow "D" in FIGS. 5, 7, and 9.

Figure 10:
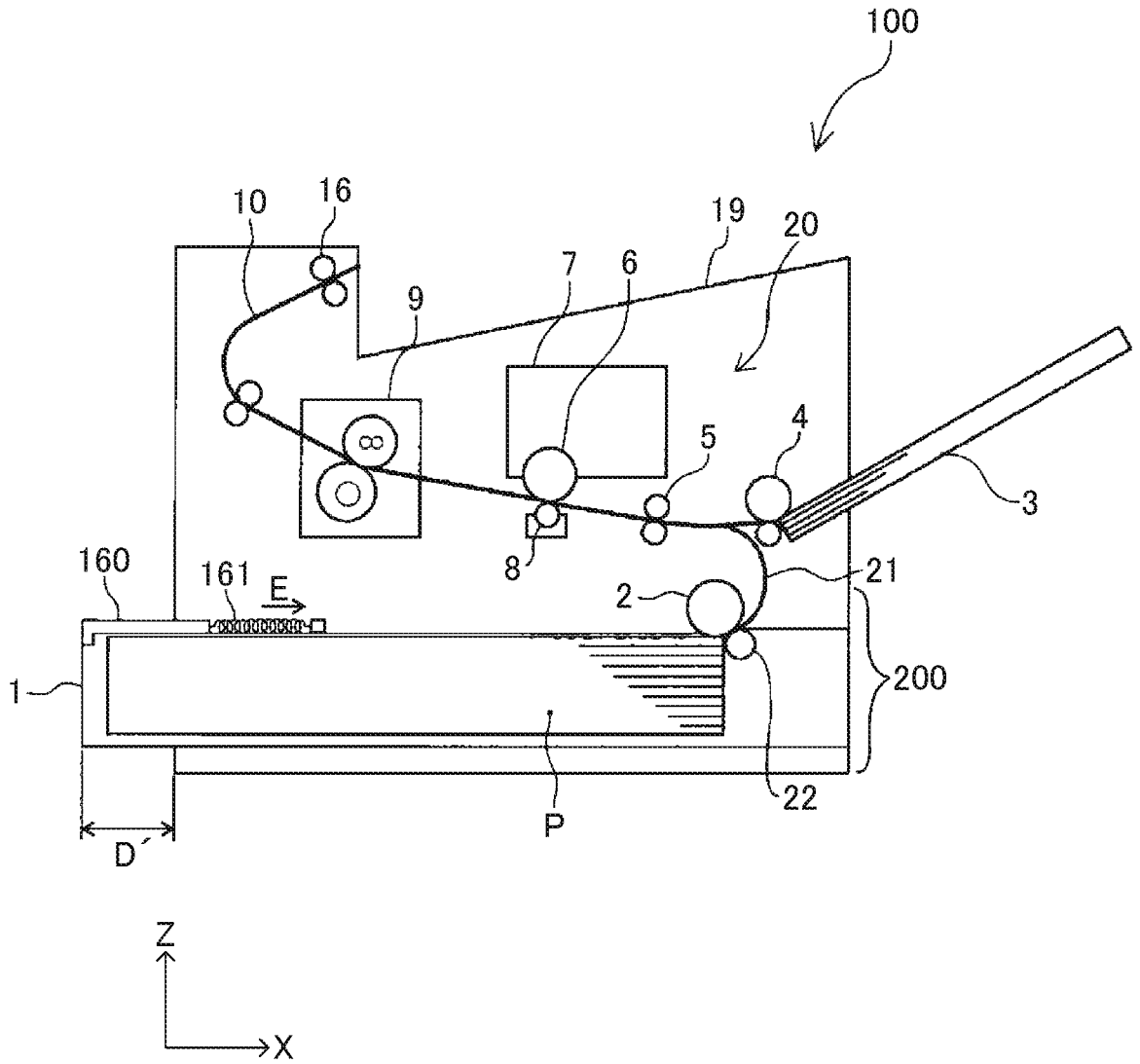
FIG. 10 is a diagram illustrating a schematic configuration of the image forming apparatus on which the sheet tray in an extended state is mounted.

FIG. 10 is a schematic configuration diagram of the image forming apparatus 100 in a state where the sheet tray 1 in the extended state is mounted. As illustrated in FIG. 10, when the sheet tray 1 in the extended state is mounted, the extended part of the sheet tray 1 protrudes from a back surface of the image forming apparatus (the left side surface in FIGS. 2 and 10), which has been planar when the sheet tray 1 in the non-extended state has been mounted.

At this time, when the trailing end side in the sheet feeding direction of the box-shaped sheet tray 1 with an upper side open is pulled out as it is, contents of the sheet tray 1 can be seen from the portion protruding from the back surface of the image forming apparatus. To cope with that, the image forming apparatus 100 includes a sheet tray upper cover 160 to cover an upper portion in the extended range on the rear side in the sheet feeding direction in the sheet tray 1.

The length in a direction parallel to the sheet feeding direction of the sheet tray upper cover 160 is longer than the length of the extended portion of the sheet tray 1 illustrated by the arrow "D" in FIGS. 5, 7, and 9. With the configuration, a range of the extended portion (the range illustrated by the arrow "D'" in FIG. 10) protruding as the sheet tray 1 in the extended state is mounted is covered with the sheet tray upper cover 160, and the contents of the sheet tray 1 can be completely hidden.

The image forming apparatus 100 includes a cover biasing spring 161 to bias the sheet tray upper cover 160 in the sheet feeding direction (the direction of the arrow "E" in FIG. 10). With the cover biasing spring 161, when the sheet tray 1 in the non-extended state is mounted, the sheet tray upper cover 160 is fit inside the back surface of the image forming apparatus together with the sheet tray 1, and the back surface of the image forming apparatus can be kept planar as illustrated in FIG. 2. Further, when the sheet tray 1 in the extended state is mounted, the sheet tray upper cover 160 is pulled by the sheet tray 1 against the biasing force of the cover biasing spring 161 and is in a pulled state from the back surface of the image forming apparatus together with the sheet tray 1. Thereby, the sheet tray upper cover 160 can cover the protruding portion of the sheet tray 1 and prevent the contents from being seen.

The slider 60 included in the sheet tray 1 of the present embodiment includes a connecting slider 90 in which the connecting holes 61*a* and 61*b* which the connecting claws 44*a* and 44*b* enter are formed, and a fence holding slider 80 holding the end fence 51 and slidable in the sheet feeding direction with respect to the connecting slider 90. Then, the fence holding slider 80 is brought to slide with respect to the connecting slider 90, whereby the length in the sheet feeding direction of the slider 60 can be changed in two stages of a non-extended state and an extended state according to the length in the sheet feeding direction of the tray housing 30. By changing the length in the sheet feeding direction of the slider 60, the distance in the sheet feeding direction from the connecting holes 61*a* and 61*b* to the end fence 51 can be changed. Thereby, the slider 60 is set to the extended state in the state where the tray housing 30 is in the extended state, whereby the end fence 51 can be brought to abut against the trailing end of the sheet P in legal size.

Figure 11:
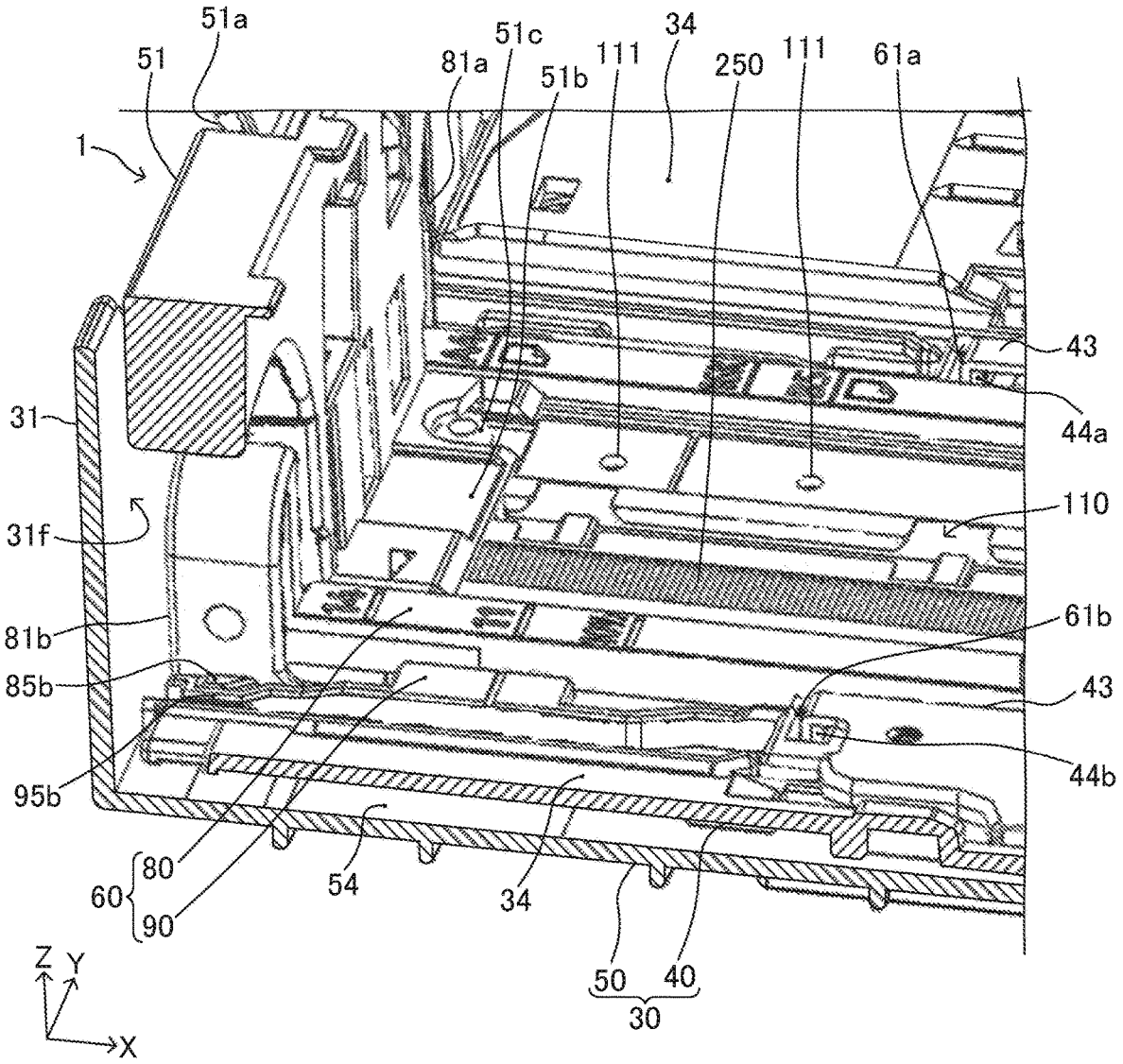
FIG. 11 is a perspective cross-sectional view illustrating the sheet tray, with a tray housing and a slider both in a non-extended state near an end fence.
Figure 12:
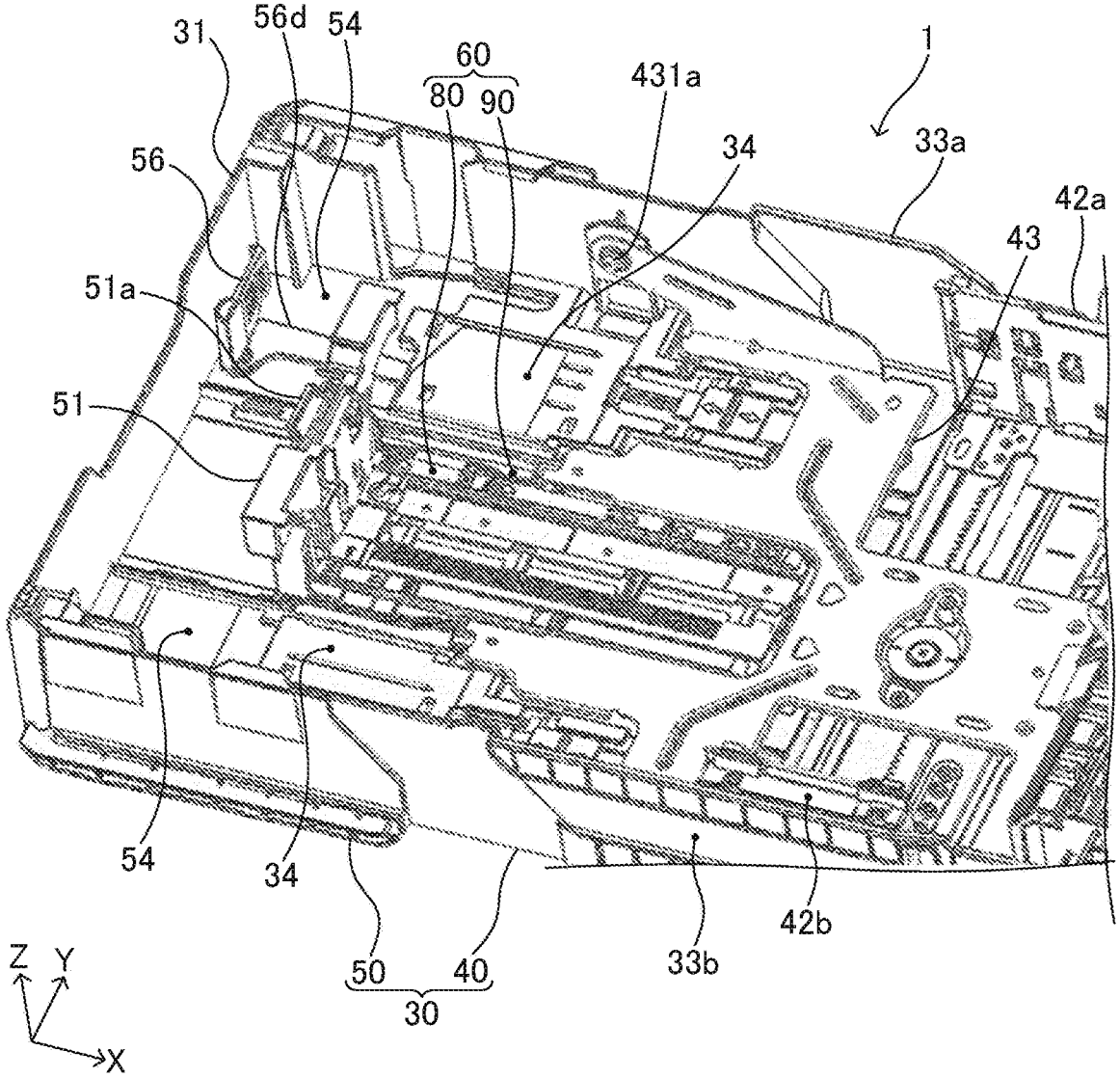
FIG. 12 is a perspective view illustrating a rear side of the sheet tray, with the tray housing in an extended state and the slider in a non-extended state.

FIG. 11 is a perspective cross-sectional view of a vicinity of the end fence 51 of the sheet tray 1 in which the tray housing 30 and the slider 60 are both in the non-extended state. FIG. 12 is a perspective explanatory view of the rear side of the sheet tray 1 in which the tray housing 30 is in the extended state and the slider 60 is in the non-extended state. The sheet tray 1 illustrated in FIG. 11 is in the same state as the sheet tray 1 in the non-extended state illustrated in FIGS. 4, 6 and 8. Further, by setting the slider 60 to the extended state from the state illustrated in FIG. 12, the state of the sheet tray 1 in the extended state illustrated in FIGS. 5, 7, and 9 is obtained.

Figure 13A:
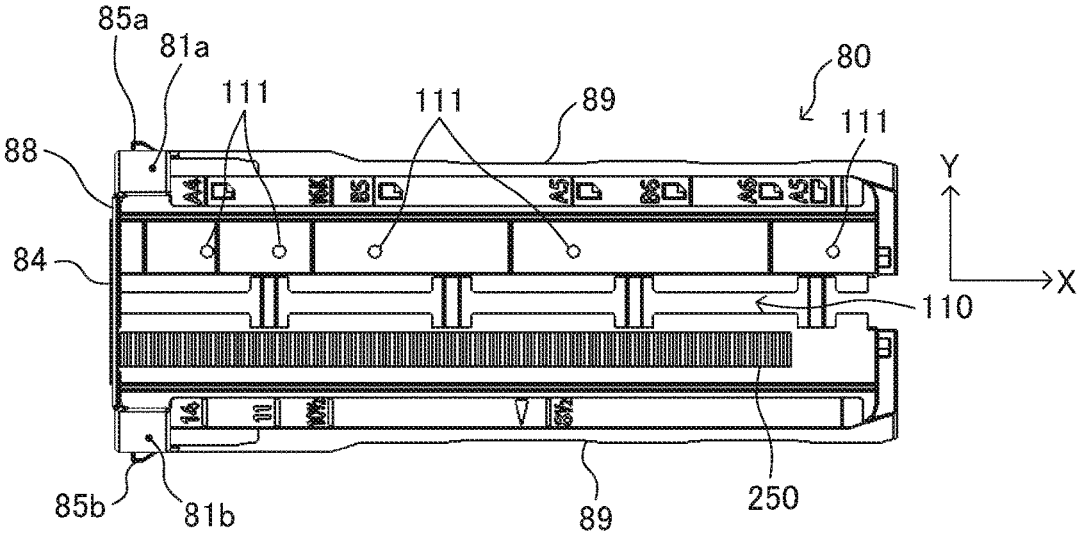
FIG. 13A is a top view illustrating a fence holding slider.
Figure 13B:
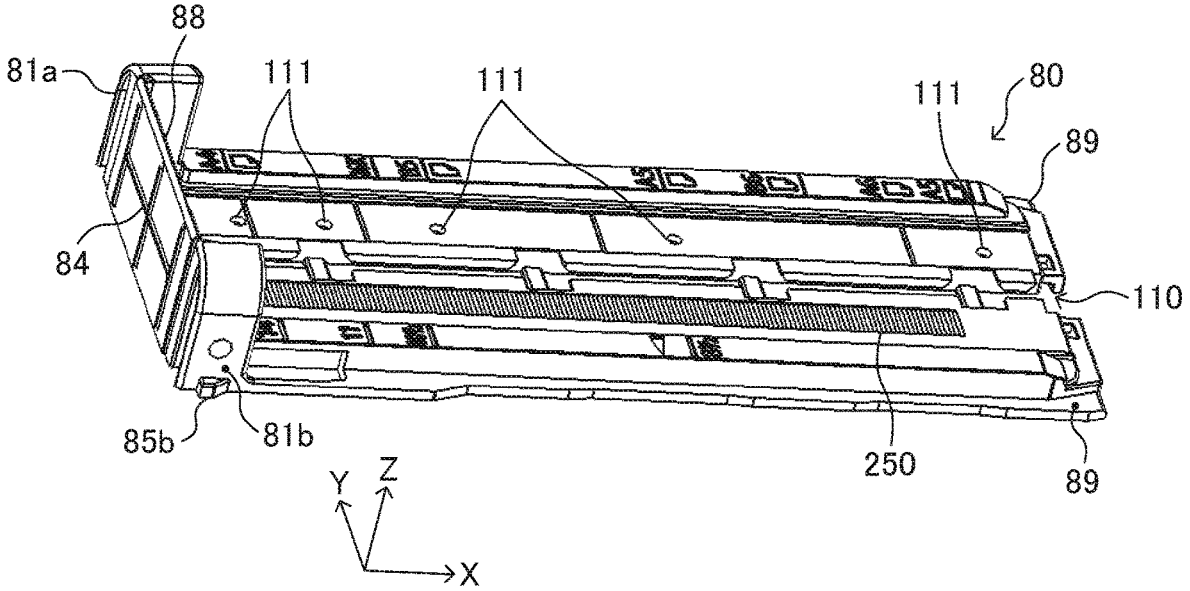
FIG. 13B is a perspective view illustrating the fence holding slider of FIG. 13A, viewed from above.
Figure 14A:
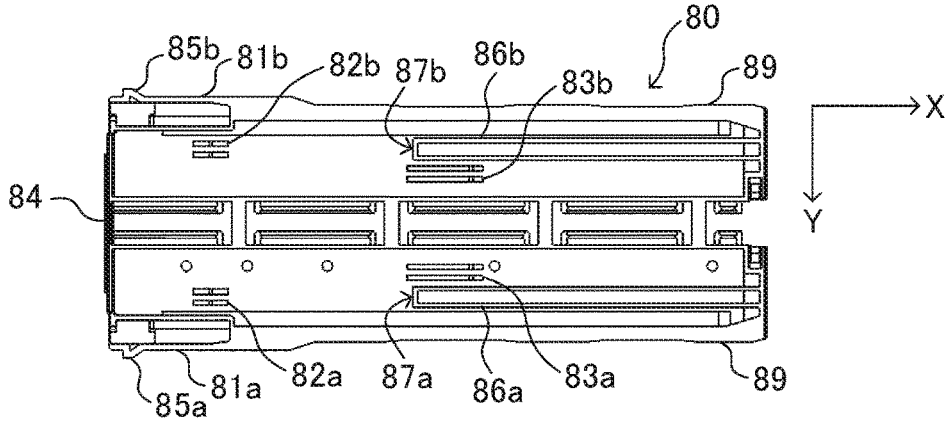
FIG. 14A is a bottom view illustrating the fence holding slider.
Figure 14B:
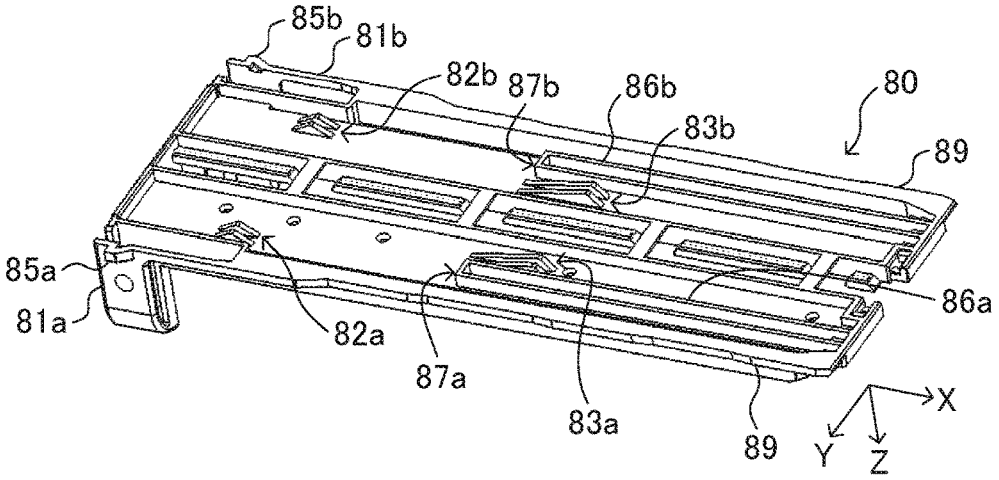
FIG. 14B is a perspective view illustrating the fence holding slider of FIG. 14A, viewed from below.
Figure 14C:
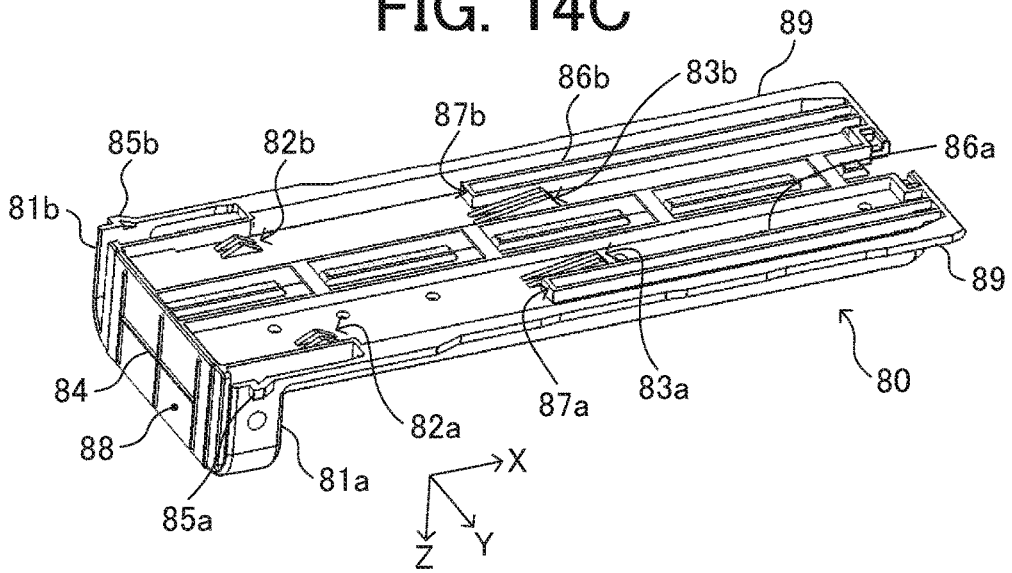
FIG. 14C is a perspective view illustrating the fence holding slider of FIG. 14A, viewed from below and from different angle of FIG. 14B.
Figure 15A:
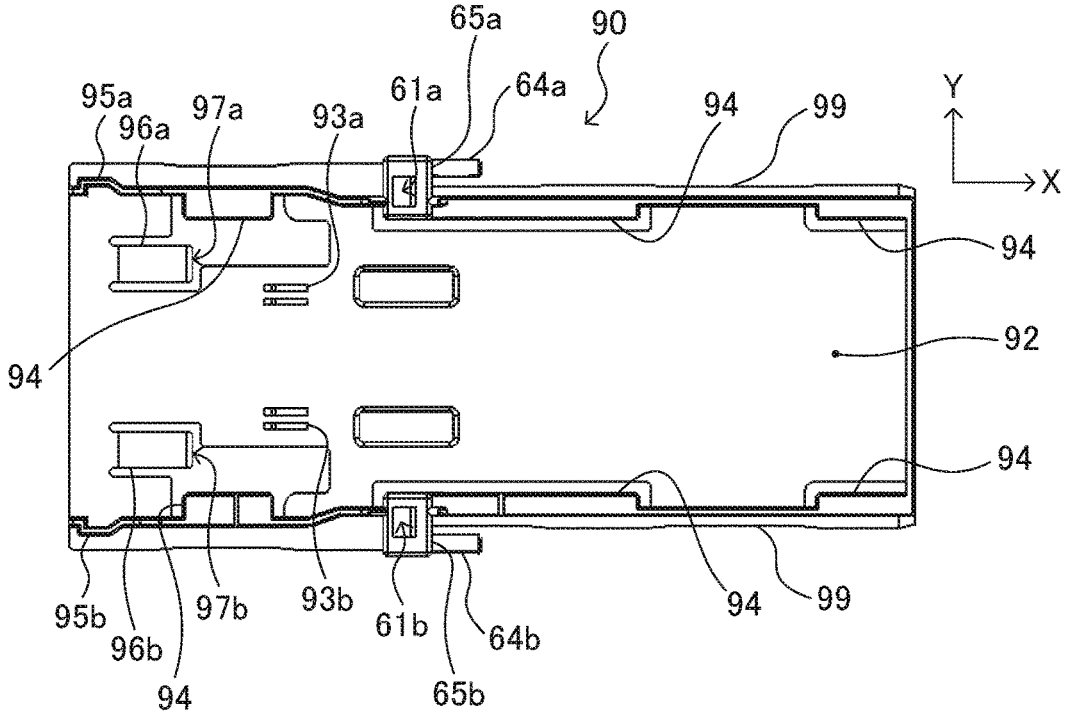
FIG. 15A is a top view illustrating a connecting slider.
Figure 15B:
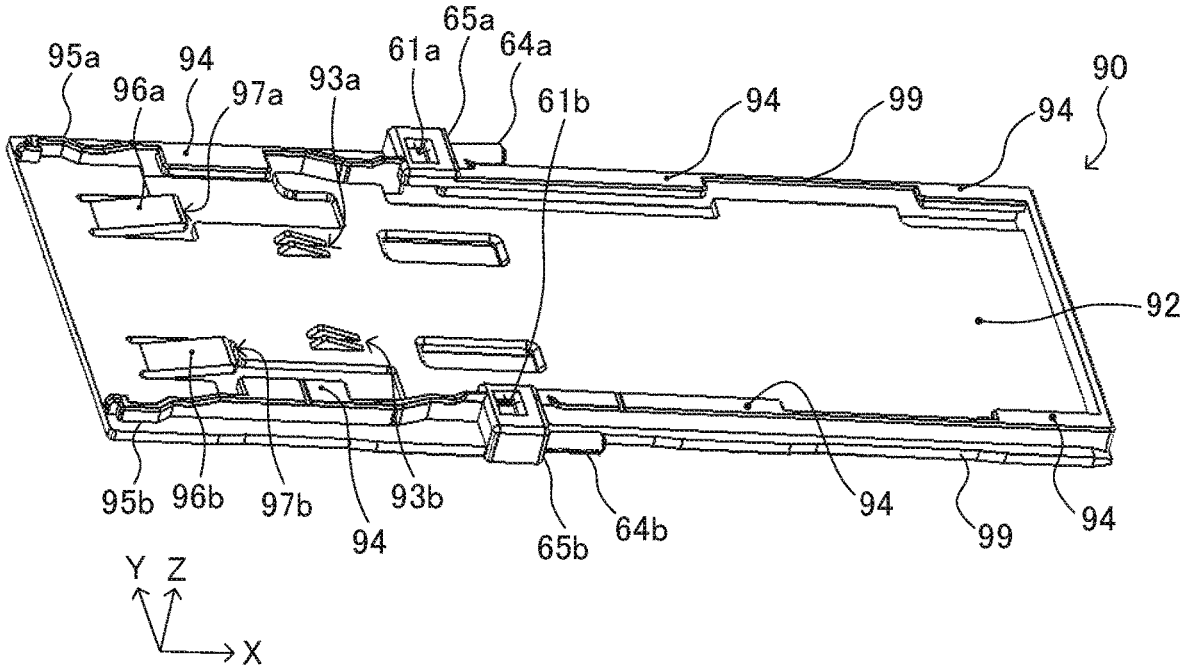
FIG. 15B is a perspective view illustrating the connecting slider of FIG. 15A, viewed from above.

FIGS. 13A and 13B are explanatory views of the fence holding slider 80 as viewed from above, and FIG. 13A is a top view of the fence holding slider 80 and FIG. 13B is an upper perspective view of the fence holding slider 80. FIGS. 14A, 14B, and 14C are explanatory views of the fence holding slider 80 as viewed from below. FIG. 14A is a bottom view of the fence holding slider 80, FIG. 14B is a lower perspective view of the fence holding slider 80, and FIG. 14C is a lower perspective view of the fence holding slider 80 as viewed at a different angle from FIG. 14B. FIGS. 15A and 15B are explanatory views of the connecting slider 90, and FIG. 15A is a top view of the connecting slider 90 and FIG. 15B is an upper perspective view of the connecting slider 90.

As illustrated in FIGS. 13A and 13B and FIGS. 14A to 14C, the fence holding slider 80 includes guided portions 89 extending in the sheet feeding direction (X-axis direction) at both end in the width direction (Y-axis direction). Further, as illustrated in FIGS. 15A and 15B, the connecting slider 90 includes guide walls 99 extending in the sheet feeding direction at both ends in the width direction of a substantially planar slider base 92 forming an outer shape. Further, the connecting slider 90 includes guide claws 94 facing the slider base 92 across a space at three places in the sheet feeding direction at upper end portions of the guide walls 99.

The fence holding slider 80 is brought to slide from the upstream side in the sheet feeding direction (the left side in FIGS. 15A and 15B) with respect to the connecting slider 90 so that the guided portions 89 enter a guide space between the slider base 92 and the guide claws 94. As a result, end surfaces in the width direction of the guided portions 89 at both ends in the width direction of the fence holding slider 80 abut against inner surfaces in the width direction of the guide walls 99, and the fence holding slider 80 is positioned in the width direction (Y-axis direction) relative to the connecting slider 90. Further, the guided portions 89 are caught between the slider base 92 and the guide claws 94, so that the fence holding slider 80 is positioned in the up-down direction (Z-axis direction) relative to the connecting slider 90. The guided portions 89 are brought to enter and engaged with the guide space, whereby the fence holding slider 80 becomes slidable along the feeding direction with respect to the connecting slider 90.

As illustrated in FIGS. 13A and 13B and FIGS. 14A to 14C, the fence holding slider 80 includes securement release buttons 81*a* and 81*b* at both ends in the width direction near upstream ends in the sheet feeding direction. Further, the fence holding slider 80 includes non-extended state securing protrusions 85*a* and 85*b* in lower end portions of the securement release buttons 81*a* and 81*b*. As illustrated in FIGS. 14A to 14C, a lower surface of the fence holding slider 80 is provided with extended state positioning ribs 86*a* and 86*b*, extended state positioning lower protrusions 83*a* and 83*b*, and non-extended state positioning lower protrusions 82*a* and 82*b*.

Meanwhile, as illustrated in FIGS. 15A and 15B, a lower surface of the connecting slider 90 is provided with positioning upper protrusions 93*a* and 93*b* and extended state positioning claws 96*a* and 96*b*. Further, non-extended state securing recesses 95*a* and 95*b* are formed in upstream ends in the sheet feeding direction of the guide walls 99 on the upper surface side of the connecting slider 90.

When the guided portions 89 are engaged with the guide space and the fence holding slider 80 is brought to slide toward the downstream side in the sheet feeding direction of the connecting slider 90, the extended state positioning claws 96*a* and 96*b* are pushed by the extended state positioning ribs 86*a* and 86*b* and bent downward. When the fence holding slider 80 further slides in the state where the extended state positioning claws 96*a* and 96*b* are bent downward, the extended state positioning lower protrusions 83*a* and 83*b* abut against the positioning upper protrusions 93*a* and 93*b*. In this abutting state, the extended state positioning ribs 86*a* and 86*b* have passed through above the extended state positioning claws 96*a* and 96*b* and thus have no action to push down the extended state positioning claws 96*a* and 96*b*. As a result, the downward bending of the extended state positioning claws 96*a* and 96*b* become gone, and protrude above the upper surface of the slider base 92. At this time, positioning claw leading end surfaces 97*a* and 97*b* of downstream ends in the sheet feeding direction of the extended state positioning claws 96*a* and 96*b* and rib abutting surfaces 87*a* and 87*b* of the extended state positioning ribs 86*a* and 86*b* face and are in contact with each other.

Next, when the user or the like applies a force to the fence holding slider 80 to slide toward the downstream side in the sheet feeding direction, the extended state positioning lower protrusions 83*a* and 83*b* climb over the positioning upper protrusions 93*a* and 93*b* and the fence holding slider 80 slides. Then, the non-extended state positioning lower protrusions 82*a* and 82*b* abut against the positioning upper protrusions 93*a* and 93*b*. At this time, the non-extended state positioning lower protrusions 82*a* and 82*b* of the fence holding slider 80 are engaged with the non-extended state securing recesses 95*a* and 95*b* (see FIG. 11). With the engagement, the fence holding slider 80 is positioned in the sheet feeding direction relative to the connecting slider 90, and the position of the fence holding slider 80 relative to the connecting slider 90 can be secured in the positional relationship where the slider 60 is in the non-extended state.

To set the slider 60 in the non-extended state to the extended state, first, the two securement release buttons 81*a* and 81*b* are held to move inward in the width direction, so that the securement release buttons 81*a* and 81*b* are elastically deformed inward. With the deformation, the non-extended state securing protrusions 85*a* and 85*b* included in the securement release buttons 81*a* and 81*b* move inward in the width direction, and the engagement between the non-extended state securing protrusions 85*a* and 85*b* and the non-extended state securing recesses 95*a* and 95*b* is released. With this engagement released, a force is applied to the fence holding slider 80 to slide to the upstream side in the sheet feeding direction while holding the securement release buttons 81*a* and 81*b*. As a result, the non-extended state positioning lower protrusions 82*a* and 82*b* climb over the positioning upper protrusions 93*a* and 93*b*, and the fence holding slider 80 slides.

When the fence holding slider 80 is further slid, the extended state positioning lower protrusions 83*a* and 83*b* reach a position where the extended state positioning lower protrusions 83*a* and 83*b* come into contact with the positioning upper protrusions 93*a* and 93*b*. As illustrated in FIGS. 14B and 14C, upstream slopes in the sheet feeding direction of the extended state positioning lower protrusions 83*a* and 83*b* are gentler in inclination than downstream slopes in the sheet feeding direction. Further, as illustrated in FIG. 15B, downstream slopes in the sheet feeding direction of the positioning upper protrusions 93*a* and 93*b* are gentler in inclination than upstream slopes in the sheet feeding direction. When the fence holding slider 80 is slid to the upstream side in the sheet feeding direction, the slopes with the gentler inclinations come into contact with each other. Therefore, the extended state positioning lower protrusions 83*a* and 83*b* can easily climb over without abutting against the positioning upper protrusions 93*a* and 93*b*.

When the extended state positioning lower protrusions 83*a* and 83*b* climb over the positioning upper protrusions 93*a* and 93*b*, the rib abutting surfaces 87*a* and 87*b* of the extended state positioning ribs 86*a* and 86*b* abut against the positioning claw leading end surfaces 97*a* and 97*b*. As a result, the slider 60 is set to the extended state. The slider 60 in the extended state prevents the fence holding slider 80 from moving to the upstream side in the sheet feeding direction with respect to the connecting slider 90 as the rib abutting surfaces 87*a* and 87*b* abut against the positioning claw leading end surfaces 97*a* and 97*b*.

Further, in the extended state, the downstream slopes in the sheet feeding direction of the extended state positioning lower protrusions 83*a* and 83*b* and the upstream slopes of the positioning upper protrusions 93*a* and 93*b* face and are in contact with each other. As illustrated in FIGS. 14B and 14C and FIG. 15B, these slopes are steep in inclination, and the slopes with steep inclinations come into contact with each other, so that the extended state positioning lower protrusions 83*a* and 83*b* abut against the positioning upper protrusions 93*a* and 93*b*. By this abutting, the fence holding slider 80 is prevented from moving to the downstream side in the sheet feeding direction with respect to the connecting slider 90.

As described above, the fence holding slider 80 can be prevented from moving to the upstream side and the downstream side in the sheet feeding direction with respect to the connecting slider 90 in the positional relationship where the slider 60 is in the extended state. Therefore, the fence holding slider 80 can be secured with respect to the connecting slider 90.

In the sheet tray 1 of the present embodiment, a holding body securing device to secure the fence holding slider 80 as a regulation moving body relative to the connecting slider 90 as a bottom plate connecting body differs between in the non-extended state and in the extended state. In the non-extended state, the non-extended state securing protrusions 85*a* and 85*b*, the non-extended state securing recesses 95*a* and 95*b*, the non-extended state positioning lower protrusions 82*a* and 82*b*, and the positioning upper protrusions 93*a* and 93*b* are the holding body securing device. Further, in the extended state, the extended state positioning ribs 86*a* and 86*b*, the extended state positioning claws 96*a* and 96*b*, the extended state positioning lower protrusions 83*a* and 83*b*, and the positioning upper protrusions 93*a* and 93*b* are the holding body securing device.

The holding body securing device to secure the fence holding slider 80 relative to the connecting slider 90 is not limited to the above-described configuration. Any configuration may be adopted as long as the configuration can secure the fence holding slider 80 relative to the connecting slider 90 in each of the extended state and the non-extended state and can release the secured state at the operator's discretion when the state is transitioned from one state to the other state. As illustrated in FIGS. 13A and 13B and FIGS. 14A to 14C, a slider abutting rib 84 to abut against the rear end wall surface 31*f* of the rear wall 31 is formed on a slider upstream-side wall portion 88 of the fence holding slider 80.

Next, a configuration to enable the end fence 51 to be movable along the sheet feeding direction with respect to the slider 60 will be described. As illustrated in FIG. 11 and FIGS. 13A and 13B, the fence holding slider 80 includes a rail groove 110 extending in a direction parallel to the feeding direction, and an end fence engaging portion protruding downward of the end fence 51 is engaged with the rail groove 110. With the engagement, the end fence 51 is slidable in the direction parallel to the feeding direction along the rail groove 110, and the rail groove 110 has a function as a guiding portion to guide the end fence 51 in a predetermined direction (X-axis direction).

As illustrated in FIG. 11 and FIGS. 13A and 13B, the fence holding slider 80 includes a fence securing rack gear 250 as a rack gear extending in the direction parallel to the feeding direction. Meanwhile, the end fence 51 includes a fence securing claw to be engaged with the fence securing rack gear 250. As the fence securing claw, a known configuration can be used. The fence securing claw is slidably supported in the up-down direction with respect to the end fence 51, and is biased downward by a biasing body such as a compression spring. A leading end of the fence securing claw biased downward is engaged with the fence securing rack gear 250, whereby the position in the sheet feeding direction of the end fence 51 can be secured at an arbitrary position relative to the fence holding slider 80.

Further, the end fence 51 includes a fence securement release lever 51*a*, and an upper end of the fence securement release lever 51*a* is rotated to move to the downstream side in the sheet feeding direction, thereby to move the fence securing claw upward against the biasing force of the biasing body. Thereby, the engagement between the leading end of the fence securing claw and the fence securing rack gear 250 is released, and the end fence 51 becomes slidable along the rail groove 110. Since the end fence 51 is slidable in the sheet feeding direction with respect to the fence holding slider 80 and can be secured at an arbitrary position, the position of the end fence 51 in the sheet feeding direction can be set in accordance with the size of the sheet P to be stored.

As illustrated in FIG. 11 and FIGS. 13A and 13B, the fence holding slider 80 includes slider-side fence securing holes 111 at five places in the feeding direction. Then, as illustrated in FIG. 11, a fence securing pin 51*c* is inserted into a fence-side securing hole provided in the fence holding body 51*b* of the end fence 51 and one of the slider-side fence securing holes 111. Thereby, movement of the end fence 51 with respect to the fence holding slider 80 can be prevented at a position where the fence securing pin 51*c* can be inserted into the slider-side fence securing hole 111.

As illustrated in FIGS. 15A and 15B, both ends in the width direction of the connecting slider 90 are provided with spring engaging bosses 64*a* and 64*b* to be engaged with coil-like slider biasing springs 62*a* and 62*b*. Then, at the time of assembly, the coil-like slider biasing springs 62*a* and 62*b* are brought to be engaged with the spring engaging bosses 64*a* and 64*b*. With the engagement, upstream ends in the sheet feeding direction of the slider biasing springs 62*a* and 62*b* can be brought to abut against slider-side spring abutting portions 65 (that is, slider-side spring abutting portions 65*a* and 65*b*) as an abutting portion of the slider biasing spring 62 on the slider 60 side.

The lower surface 34 forming the lower surface of the sheet tray 1 in the non-extended state illustrated in FIGS. 4 and 8 is a part of the front housing 40. An extended lower surface 54 forming an upstream portion in the sheet feeding direction of the lower surface of the sheet tray 1 in the extended state illustrated in FIGS. 5 and 8 is a part of the rear housing 50. In the non-extended state, the extended lower surface 54 is located below the lower surface 34. In the extended state, the extended lower surface 54 is drawn out from below the lower surface 34 and exposed. The spring abutting portions 63*a* and 63*b* against which the downstream ends in the sheet feeding direction of the slider biasing springs 62*a* and 62*b* abut are provided on the lower surface 34 as a part of the front housing 40.

Figure 16:
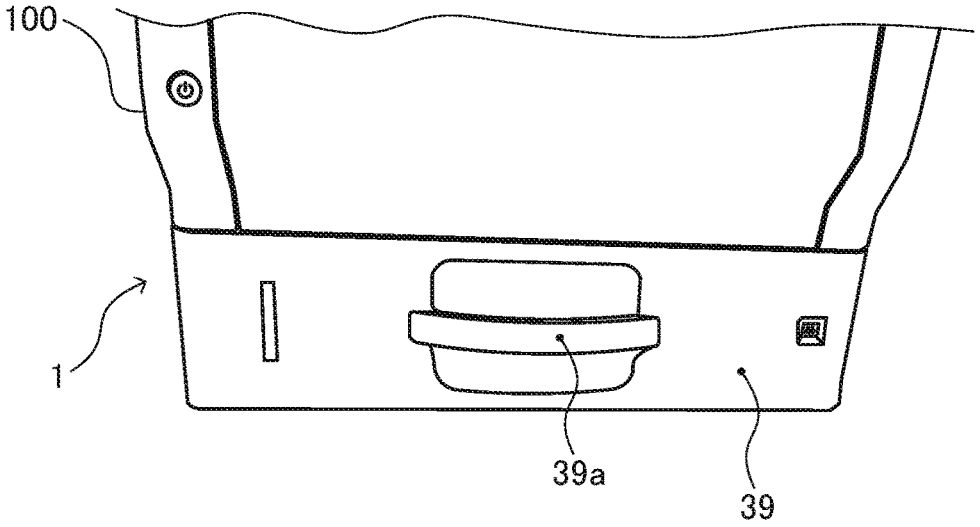
FIG. 16 is a diagram illustrating a lower portion of the image forming apparatus with the sheet tray attached, viewed from the right side of FIG. 2.
Figure 17:
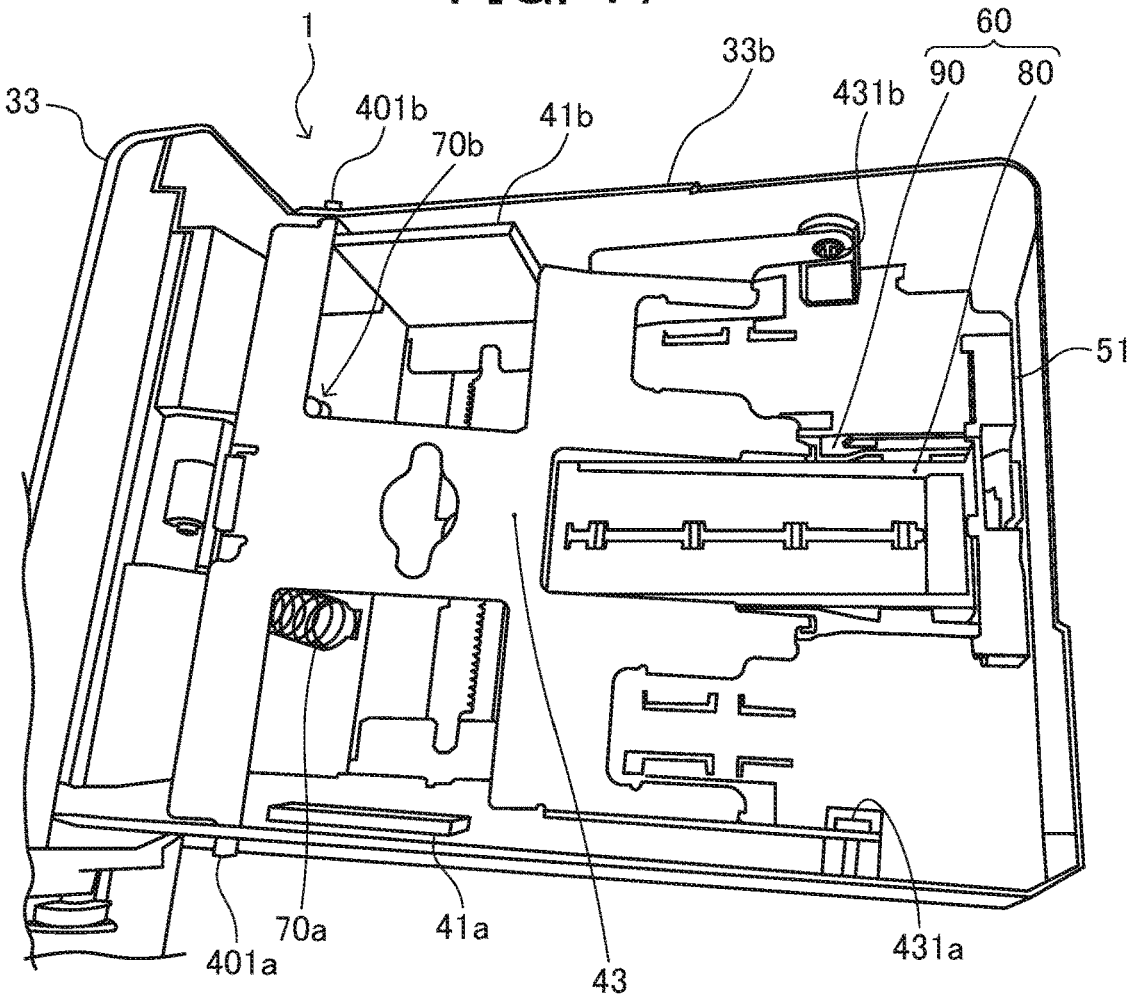
FIG. 17 is a perspective top view illustrating the sheet tray attached to the image forming apparatus.

Next, the bottom plate descending mechanism to lower the downstream end in the sheet feeding direction of the bottom plate 43 of the sheet tray 1 and the bottom plate securing mechanism to secure the bottom plate 43 in the state where the downstream end in the sheet feeding direction has completely lowered will be described. FIG. 16 is an explanatory view of a lower portion of the image forming apparatus 100 when the image forming apparatus 100 in the state where the sheet tray 1 is set is viewed from the right side in FIG. 2. FIG. 17 is a perspective top view of the sheet tray 1 set in the image forming apparatus 100. In the state where the sheet tray 1 is set to the image forming apparatus 100, the securement of the bottom plate 43 by the bottom plate securing mechanism is released. Therefore, as illustrated in FIG. 17, the downstream end in the sheet feeding direction of the bottom plate 43 is pushed up by the bottom plate ascending springs 70 (i.e., the bottom plate ascending springs 70*a* and 70*b*) and has completely risen. As illustrated in FIGS. 4, 5, and 16, the downstream side in the sheet feeding direction of the sheet tray 1 is covered with a tray exterior cover 39, and a tray handle 39*a* provided on the tray exterior cover 39 is held and pulled, whereby the sheet tray 1 can be drawn out from the image forming apparatus 100.

Figure 18:
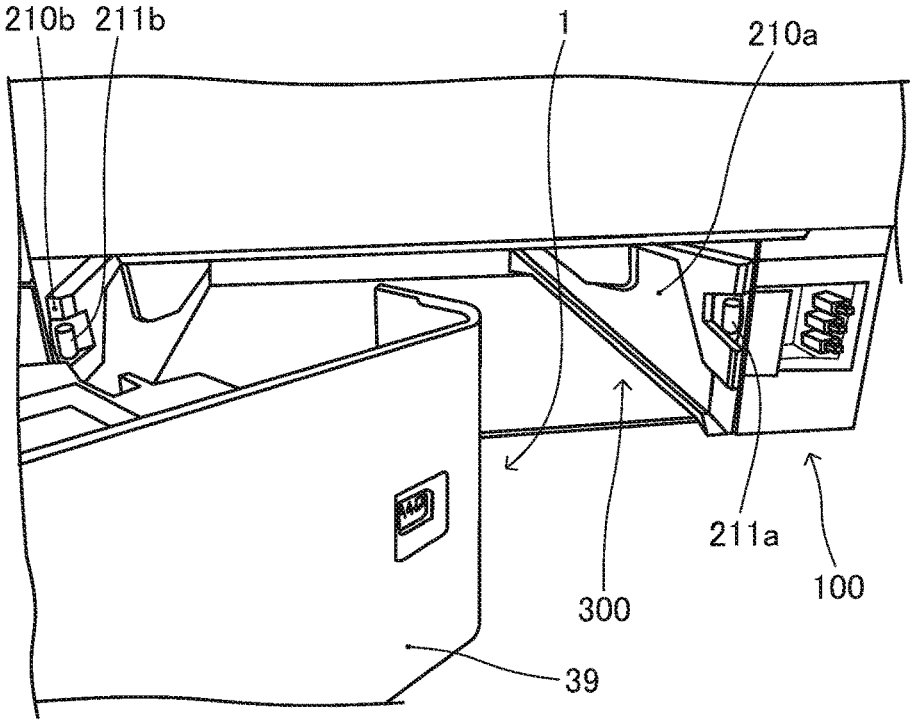
FIG. 18 is a diagram illustrating the lower portion of the image forming apparatus with the sheet tray being pulled out.

FIG. 18 is an explanatory view of a lower portion of the image forming apparatus 100 in a state where the sheet tray 1 is drawn out from the state illustrated in FIG. 16. As illustrated in FIG. 18, when the sheet tray 1 is drawn out, a sheet tray insertion opening 300 formed in a lower portion of the image forming apparatus 100 is exposed. A left tray guide 210*b* and a right tray guide 210*a* are arranged on the right and left of the sheet tray insertion opening 300, respectively.

Figure 19:
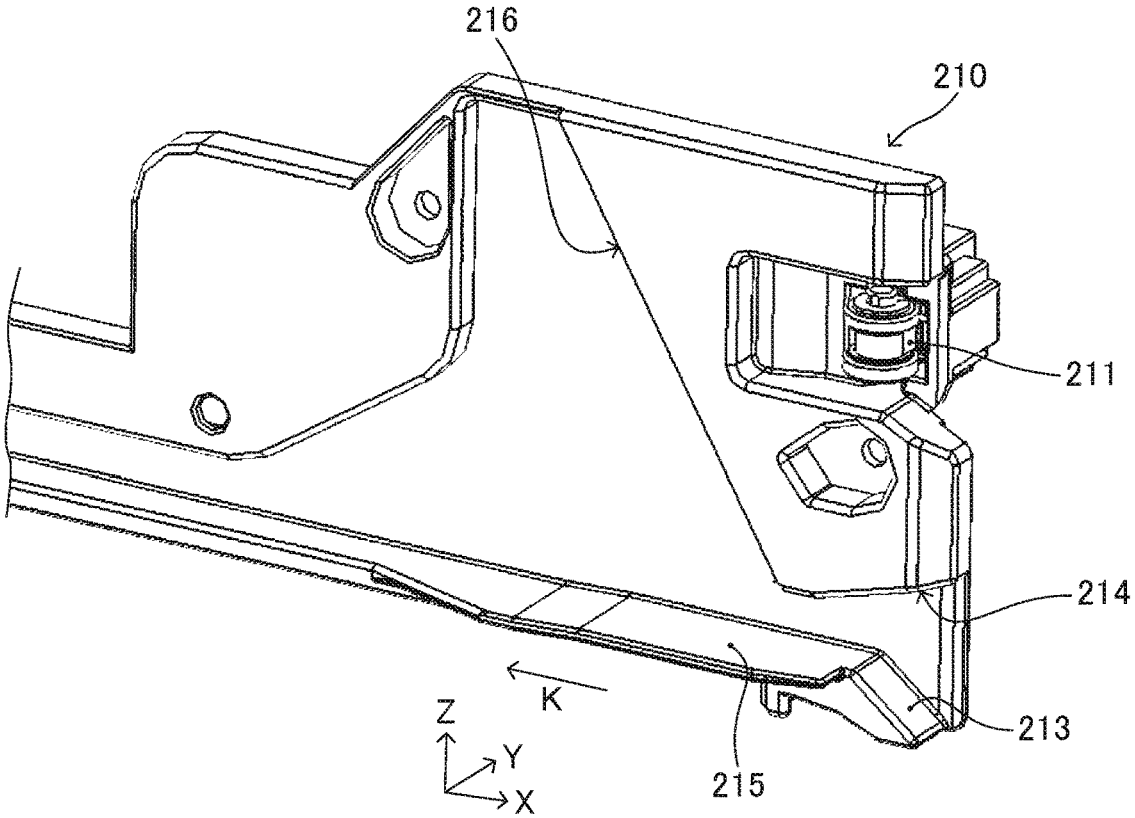
FIG. 19 is a perspective view illustrating a downstream side of a tray guide in a sheet feeding direction.

FIG. 19 is a perspective explanatory view of the right tray guide 210*a* on a downstream side in the sheet feeding direction, of the two tray guides 210 (210*a* and 210*b*). Since the two tray guides 210 have the same configuration with left and right flipped shapes, "a" indicating a right-side member is omitted in FIG. 19 and the description of FIG. 19. For the right-side configurations of the sheet tray 1 illustrated in FIGS. 20 and 21, "a" is similarly omitted and description will be given.

Figure 20:
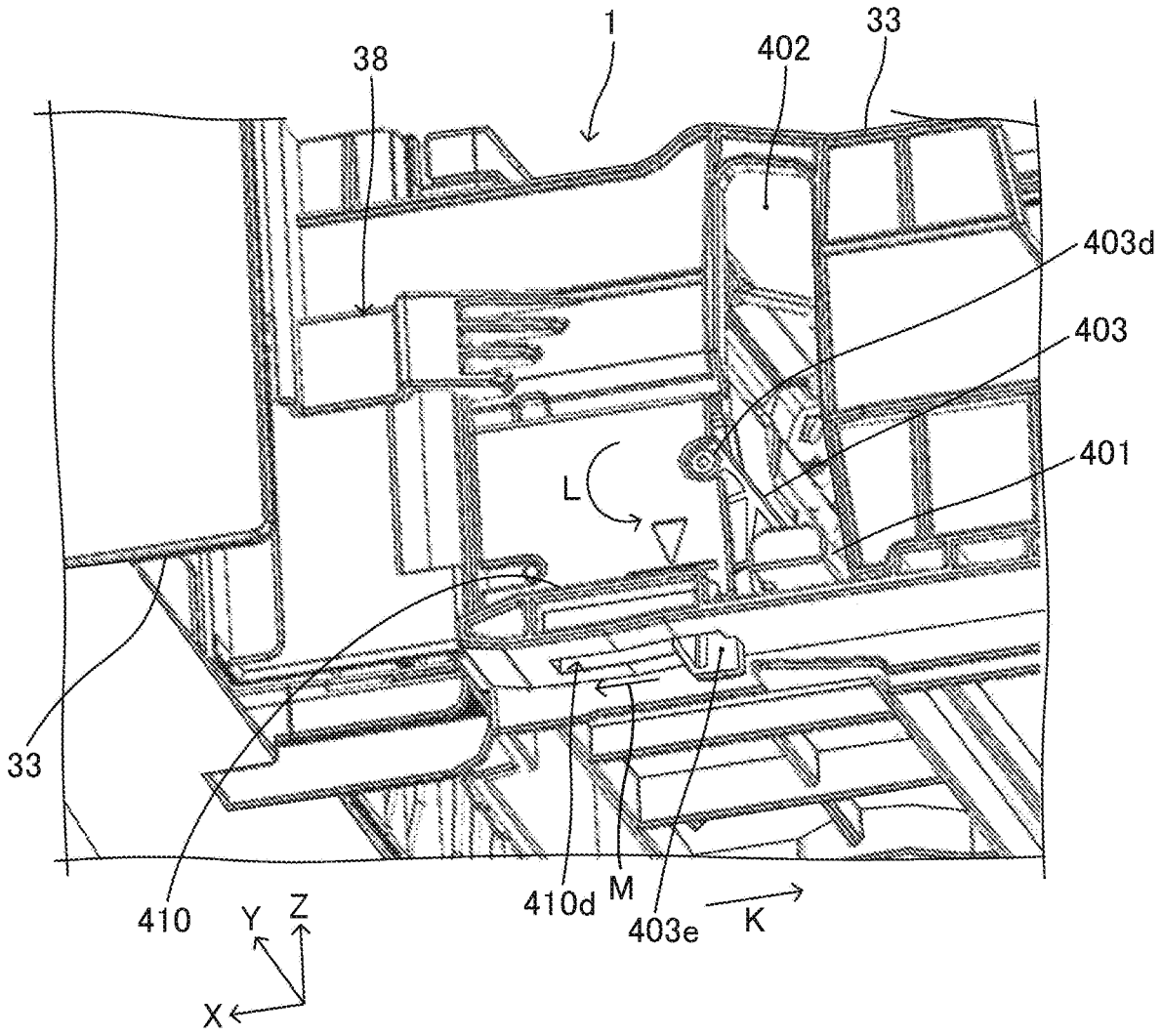
FIG. 20 is a perspective view illustrating a right side front end portion of the sheet tray, viewed from an obliquely lower side in the width direction of an outside of the sheet tray.
Figure 21:
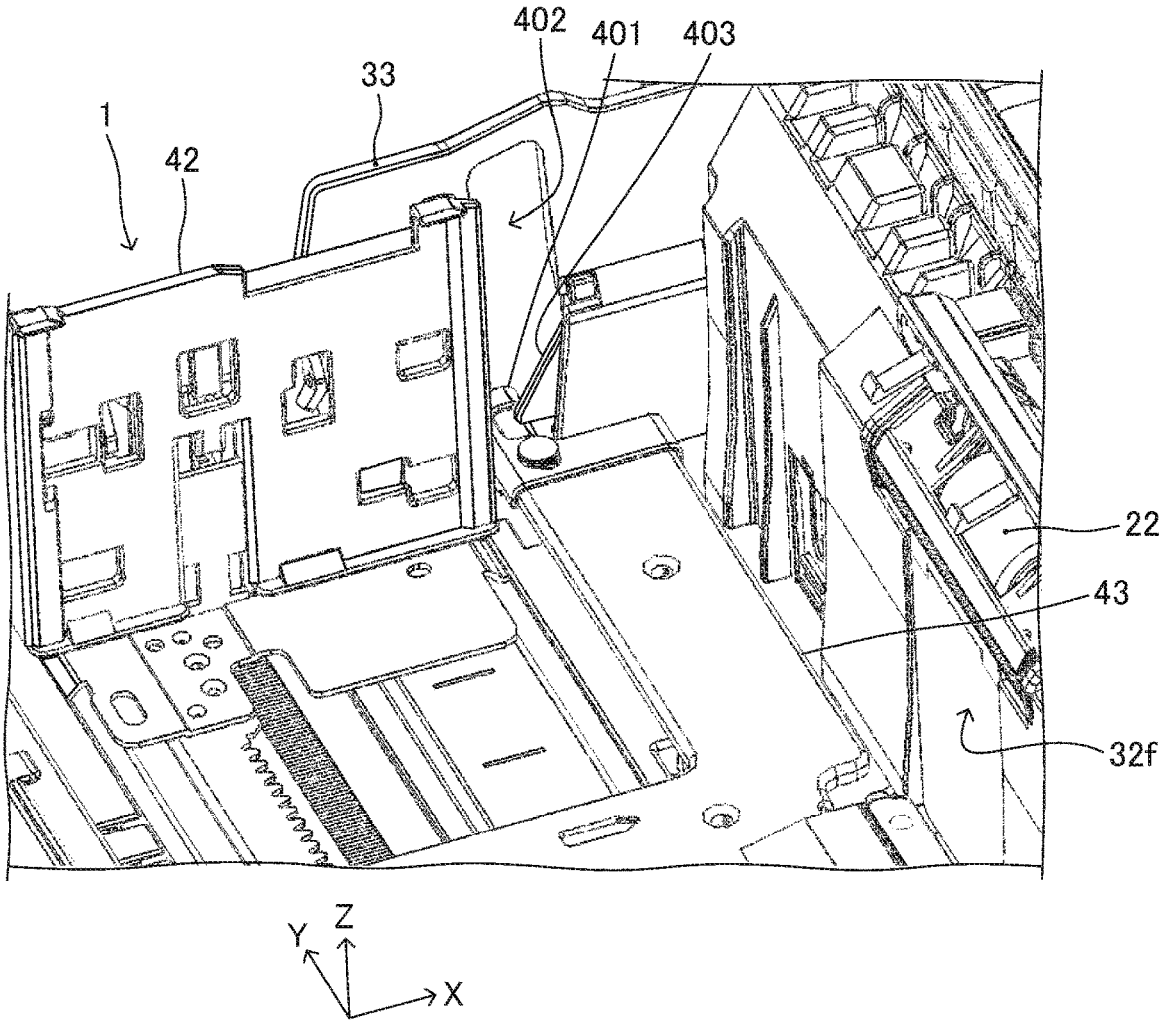
FIG. 21 is a perspective view illustrating the right side front end portion of the sheet tray, viewed from an obliquely lower side in the width direction of an inside of the sheet tray.

FIG. 20 is a perspective explanatory view of a right front end portion of the sheet tray 1, which is the right side of the image forming apparatus 100 in the explanatory view illustrated in FIG. 16, as viewed from obliquely below at an outside in the width direction. FIG. 21 is a perspective explanatory view of a right front end portion of the sheet tray 1 as viewed from obliquely above at an inside in the width direction. The sheet tray 1 illustrated in FIGS. 20 and 21 is in a state where the sheet tray 1 has been taken out of the image forming apparatus 100, and the downstream end in the sheet feeding direction of the bottom plate 43 has completely lowered.

As illustrated in FIGS. 20 and 21, the side wall 33 is provided with side wall arc holes 402 having an arc shape (that is, a right arc-shaped side wall arc hole 402*a* illustrated in FIG. 6 and a left arc-shaped side wall arc hole) centered on the bottom plate rotation shafts 431*a* and 431*b*. Bottom plate lateral projections 401 (that is, bottom plate lateral projections 401*a* and 401*b*) are provided on respective end portions in the width direction of the downstream end in the sheet feeding direction of the bottom plate 43. The bottom plate lateral projections 401*a* and 401*b* of the bottom plate 43 arranged inside in the width direction of the side wall 33 goes through the side wall arc holes 402 (that is, the right arc-shaped side wall arc hole 402*a* illustrated in FIG. 6 and the left arc-shaped side wall arc hole), so that a leading end of each of the bottom plate lateral projections 401*a* and 401*b* are located outside the side wall in the width direction. The bottom plate lateral projections 401*a* and 401*b* move in the up-down direction in the side wall arc hole 402, so that the bottom plate 43 rotates about the bottom plate rotation shafts 431*a* and 431*b*. It is to be noted that the suffixes of the bottom plate lateral projections 401*a* and 401*b* are occasionally omitted and explained simply as "401" in the drawings and the embodiments when both the bottom plate lateral projections 401*a* and 401*b* are applicable to the configuration. It is also to be noted that the suffix of the right arc-shaped side wall arc hole 402*a* is occasionally omitted and explained simply as "402" in the drawings when both the right arc-shaped side wall arc hole 402*a* and the left arc-shaped side wall arc hole are applicable to the configuration.

A bottom plate locking member 403 is arranged such that a part of the bottom plate locking member 403 protrudes from an upstream edge in the sheet feeding direction of the side wall arc holes 402 (i.e., the right arc-shaped side wall arc hole 402*a* and the left arc-shaped side wall arc hole) in the side wall 33 into the side wall arc holes 402. The bottom plate locking member 403 is rotatably supported about a locking member rotation shaft 403*d* with respect to the side wall 33. The bottom plate locking member 403 is biased to rotate in the direction illustrated by the arrow "L" in FIG. 20 about the locking member rotation shaft 403*d* by a biasing body such as a torsion coil spring. A locking member lower protrusion 403*e* of the bottom plate locking member 403 protrudes downward to a point lower than a lower surface of a tray guided portion 410 through a guided portion hole 410*d* of the tray guided portion 410. The locking member lower protrusion 403*e* pf the bottom plate locking member 403 biased by the biasing body abuts against an upstream edge in the sheet feeding direction of the guided portion hole 410*d*, so that the position of the bottom plate locking member 403 relative to the side wall 33 is positioned in the state illustrated in FIG. 20 and the like.

In the state illustrated in FIG. 20 and the like, the bottom plate lateral projection 401 (i.e., either one of the bottom plate lateral projections 401*a* and 401*b*) of the downstream end in the sheet feeding direction of the bottom plate 43, which is about to rise by the bottom plate ascending springs 70 (i.e., the bottom plate ascending springs 70*a* and 70*b*), abuts against a lower surface of a portion of the bottom plate locking member 403, the portion protruding into the side wall arc holes 402 (i.e., the right arc-shaped side wall arc hole 402*a* and the left arc-shaped side wall arc hole). With the abutting, the position of the bottom plate 43 is secured in the state where the downstream end in the sheet feeding direction of the bottom plate 43 has completely lowered, and the bottom plate locking member 403 functions as the bottom plate securing mechanism.

When the sheet tray 1 in the state illustrated in FIGS. 20 and 21 is inserted into the sheet tray insertion opening 300, the position in the up-down direction of an upstream end in the sheet feeding direction of the tray guided portion 410 extending in the sheet feeding direction is guided by an inlet lower slope 213 and an inlet upper slope 214 of the tray guide 210. With the guiding, the lower surface of the tray guided portion 410 is supported on an upper surface of a tray supporting portion 215. When the sheet tray 1 is further inserted, the sheet tray 1 moves toward the upstream side in the sheet feeding direction illustrated by the arrow "K" in FIGS. 19 and 20. Then, the locking member lower protrusion 403*e* protruding downward to a point lower than the lower surface of the tray guided portion 410 abuts against a downstream end in the sheet feeding direction of the tray supporting portion 215. By further inserting the sheet tray 1 from the abutting state, a force toward a downstream side in the sheet feeding direction (the direction of the arrow "M" in FIG. 20) acts on the locking member lower protrusion 403*e*, and the bottom plate locking member 403 rotates against the biasing force in the direction illustrated by the arrow "L" in FIG. 20. By the rotation, the locking member lower protrusion 403*e* enters the guided portion hole 410*d* of the tray guided portion 410, and the portion of the bottom plate locking member 403, the portion protruding into the side wall arc holes 402 (the right arc-shaped side wall arc hole 402*a* and the left arc-shaped side wall arc hole), enters the side wall 33, and the securement of the bottom plate 43 by the bottom plate locking member 403 is released.

After the locking member lower protrusion 403*e* has entered the guided portion hole 410*d* of the tray guided portion 410, a lower end portion of the locking member lower protrusion 403*e* abuts against the upper surface of the tray supporting portion 215 coming into contact with the lower surface of the tray guided portion 410. Thereby, the state in which the securement of the bottom plate 43 by the bottom plate locking member 403 is released is maintained.

The bottom plate lateral projections 401*a* and 401*b* of the bottom plate 43 released from the securement by the bottom plate locking member 403 is about to rise by the biasing force of the bottom plate ascending springs 70 (i.e., the bottom plate ascending springs 70*a* and 70*b*). However, either one of the bottom plate lateral projections 401*a* and 401*b* abuts against a bottom plate push-down slope 216 formed on the tray guide 210 illustrated in FIG. 19. As illustrated in FIG. 19, the bottom plate push-down slope 216 is inclined to become higher toward the upstream side in the sheet feeding direction. The bottom plate lateral projections 401*a* and 401*b* abutting against the bottom plate push-down slope 216 move upward by inserting the sheet tray 1, and the bottom plate 43 rotates to raise the downstream end in the sheet feeding direction of the bottom plate 43, resulting in the state illustrated in FIG. 17. When the sheet tray 1 is inserted to the end to the image forming apparatus 100, apparatus body protrusions 211*a* and 211*b* enter respective tray-side recesses 38*a* and 38*b*, and the sheet tray 1 is secured to the apparatus body of the image forming apparatus 100.

When the sheet tray 1 is drawn, the bottom plate lateral projection 401 (i.e., the bottom plate lateral projections 401*a* and 401*b*) comes into contact with the bottom plate push-down slope 216. When the sheet tray 1 is further drawn in the contact state, the bottom plate lateral projection 401 (i.e., the bottom plate lateral projections 401*a* and 401*b*) is pushed down along the inclination of the bottom plate push-down slope 216, and the bottom plate 43 rotates to lower the downstream end in the sheet feeding direction. When or before the bottom plate lateral projection 401 (i.e., the bottom plate lateral projections 401*a* and 401*b*) reaches a lower end portion of the bottom plate push-down slope 216, the locking member lower protrusion 403*e* is located on a downstream side in the sheet feeding direction of a downstream end in the sheet feeding direction of the tray supporting portion 215. Thereby, the lower end portion of the locking member lower protrusion 403*e* stops abutting against the upper surface of the tray supporting portion 215, and the bottom plate locking member 403 rotates in the direction of the arrow "L" in FIG. 20 by the biasing force of the biasing body to bias the bottom plate locking member 403, resulting in the state illustrated in FIGS. 20 and 21. That is, the locking member lower protrusion 403*e* of the bottom plate locking member 403 protrudes downward to a point lower than the lower surface of the tray guided portion 410, and the portion of the bottom plate locking member 403 against which the bottom plate lateral projection 401 (i.e., the bottom plate lateral projections 401*a* and 401*b*) abuts protrudes into the side wall arc hole 402 (i.e., the right arc-shaped side wall arc hole 402*a* and the left arc-shaped side wall arc hole).

The bottom plate locking member 403 abuts against an upper portion of the bottom plate lateral projection 401 (i.e., the bottom plate lateral projections 401*a* and 401*b*) having reached the lower end portion of the bottom plate push-down slope 216, so that the position of the bottom plate 43 can be secured in the state where the downstream end in the sheet feeding direction biased upward by the bottom plate ascending springs 70 (i.e., the bottom plate ascending springs 70*a* and 70*b*) has completely lowered. Since the sheet tray 1 is drawn out from the image forming apparatus 100 in the above state, when the sheet tray 1 is drawn out from the image forming apparatus 100 and the sheets P are set, the downstream end in the sheet feeding direction of the bottom plate 43 has completely lowered. The bottom plate lateral projection 401 (i.e., the bottom plate lateral projections 401*a* and 401*b*) is pushed down along the bottom plate push-down slope 216, so that the downstream end in the sheet feeding direction of the bottom plate 43 descends, and the bottom plate push-down slope 216 functions as the bottom plate descending mechanism.

Next, a connecting portion of the bottom plate 43 and the slider 60 in the sheet tray 1 of the present embodiment will be described. As illustrated in FIGS. 4 and 5, the two connecting holes 61*a* and 61*b* are formed in the connecting slider 90 of the slider 60 in the sheet tray 1 of the present embodiment. Further, the bottom plate 43 is provided with connecting claws 44*a* and 44*b* respectively connected to the above-described two connecting holes 61*a* and 61*b*.

Figure 22:
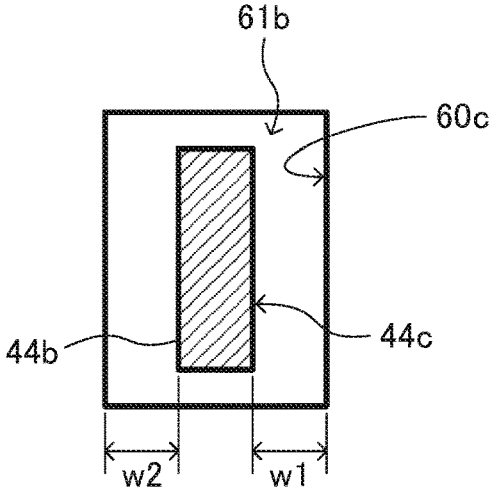
FIG. 22 is an enlarged top view illustrating a connecting portion.
Figure 23:
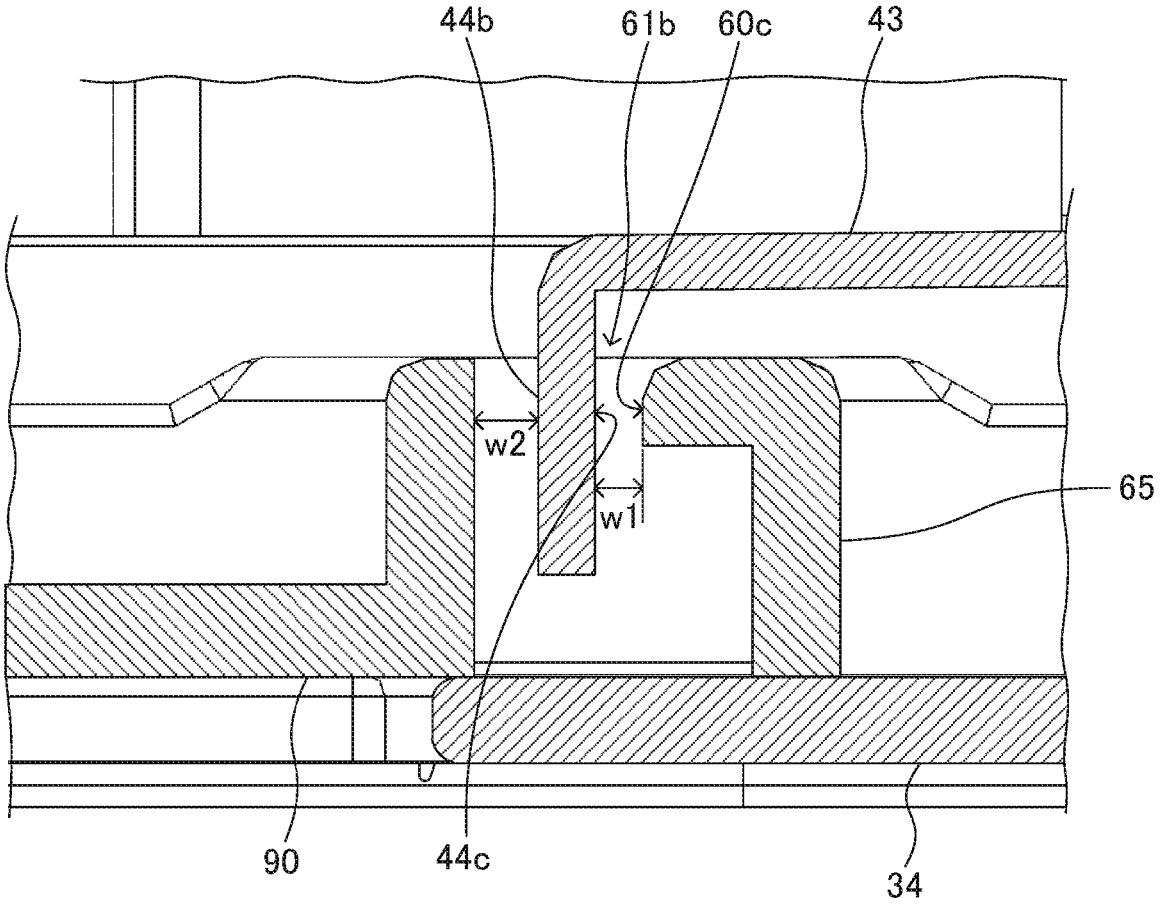
FIG. 23 is an enlarged cross-sectional side view illustrating the connecting portion.

FIG. 22 is an enlarged top view of the connecting portion illustrated by "a" in FIGS. 4 and 5, and FIG. 23 is an enlarged side cross-sectional view of the connecting portion illustrated by "β" in FIGS. 8 and 9. The sheet tray 1 includes the connecting portions in right and left two places. Since the connecting portions have a similar configuration with right and left flipped shapes, "b" indicating a left-side member is omitted in FIGS. 22 and 23 and the description of FIGS. 22 and 23.

As described in the description of the schematic side view in FIG. 1, the sheet tray 1 of the present embodiment has a configuration in which the connecting hole 61*b* provided in the slider 60 (the connecting slider 90 in FIG. 23) and the bottom plate 43 are connected, as illustrated in FIGS. 22 and 23. Further, as described in the description of the schematic side view in FIG. 1, the slider-side contact portion 60*c* and the claw-side contact portion 44*c* are not in contact with each other and form the downstream gap w1 in the state where the downstream end in the sheet feeding direction of the bottom plate 43 has completely lowered, as illustrated in FIGS. 22 and 23. Further, the upstream edge in the sheet feeding direction of the connecting hole 61*b* and the connecting claw 44*b* are not in contact, and form the upstream gap w2. It is to be noted that the connecting hole 61*a* and the connecting claw 44*a* provided to the right side of the sheet tray 1 achieve the same effect as the connection hole 61*b* and the connection claw 44*b*.

When the sheet tray 1 is taken out with respect to the image forming apparatus 100 at the time of setting the sheets P, the downstream end in the sheet feeding direction of the bottom plate 43 has completely lowered by the bottom plate push-down slope 216 composing the above-described bottom plate descending mechanism. At this time, the connecting claw 44 composing the connecting portion is located at the most upstream side in the sheet feeding direction (the left side in FIGS. 4 to 9, 22, and 23). The downstream end in the sheet feeding direction of the bottom plate 43 has a configuration to be pushed up by the bottom plate ascending springs 70 (i.e., the bottom plate ascending springs 70*a* and 70*b*) but has a configuration in which the position of the bottom plate 43 is secured by the bottom plate locking member 403 composing the bottom plate securing mechanism when the downstream end in the sheet feeding direction is pushed in a downward direction of the tray housing 30. As the configuration to secure the bottom plate 43 in the state where the downstream end in the sheet feeding direction has completely lowered, a method of pushing and lowering the bottom plate 43 by hand and securing the position of the bottom plate 43 by the bottom plate securing mechanism may be adopted.

The fence holding slider 80 is movably arranged in the sheet feeding direction with respect to the connecting slider 90, and the fence holding slider 80 can be secured to the connecting slider 90 in two places in the non-extended state and in the extended state described above. Further, the connecting slider 90 includes the connecting holes 61*a* and 61*b*, and the connecting slider 90 is connected with the bottom plate 43.

In the state where the downstream side in the sheet feeding direction of the bottom plate 43 is pushed up by the bottom plate ascending springs 70 (i.e., the bottom plate ascending springs 70*a* and 70*b*), the position in the sheet feeding direction of the slider 60 is regulated by the biasing by the slider biasing spring 62 and the abutting of the slider-side contact portion 60*c* against the claw-side contact portion 44*c*. However, in the state where the downstream end in the sheet feeding direction of the bottom plate 43 has completely lowered, the slider 60 is regulated by the rear wall 31 so as not to overshoot to the upstream side in the sheet feeding direction.

The slider 60 is biased to the upstream side in the sheet feeding direction with respect to the tray housing 30 by the slider biasing spring 62 abutting against the connecting slider 90. In the state where the downstream end in the sheet feeding direction of the bottom plate 43 has completely lowered, the fence holding slider 80 abuts against the rear wall 31 at a biased portion. In the case of a configuration including an abutted body separately from the rear wall 31, the configuration is not limited to the configuration in which the fence holding slider 80 abuts against the abutted body, and a configuration in which the connecting slider 90 abuts against the abutted body may be adopted.

In the state where the downstream end in the sheet feeding direction of the bottom plate 43 has completely lowered and the slider 60 has slid close to the upstream side in the sheet feeding direction, the upstream gap w2 is formed between the upstream edge in the sheet feeding direction of the connecting hole 61*b* and the connecting claw 44*b*, as illustrated in FIGS. 22 and 23. Further, the downstream gap w1 is formed between the slider-side contact portion 60*c* as a part of the downstream edge in the sheet feeding direction of the connecting hole 61*b* and the claw-side contact portion 44*c* of the connecting claw 44*b*. As described above, the gaps are secured on the upstream side in the sheet feeding direction and on the downstream side in the sheet feeding direction, respectively, by the connecting claw 44 with respect to the edge of the connecting hole 61*b*.

The upstream gap w2 is formed in consideration of variation in manufacturing parts and variation at the time of assembly. Otherwise the parts cannot be arranged, and the sheet tray 1 having the configuration in which the bottom plate 43 and the slider 60 are connected may not be able to be assembled.

When setting the sheet P on the sheet tray 1 of the present embodiment, the sheet P is placed at the position between the front wall 32 and the end fence 51. Since the end fence 51 is movable in the sheet feeding direction with respect to the slider 60 and can be secured at an arbitrary position, the end fence 51 is brought into contact with the trailing end of the sheet P placed in the tray housing 30 to secure the position. The end fence 51 is movable in the sheet feeding direction when the fence securement release lever 51*a* is held and gripped.

The tray housing 30 can be divided into two members of the front housing 40 and the rear housing 50, and the rear housing 50 is movable with respect to the front housing 40 to widen the space where the sheet P is placed. When moving the rear housing 50 to widen the space where the sheet P is placed, the fence holding slider 80 is moved with respect to the connecting slider 90, whereby the position of the end fence 51 can follow the movement when the space where the sheet P is placed is widened.

In a case where the tray housing 30 cannot be divided, and the length in the feeding direction of the tray housing 30 does not vary, the slider 60 may be configured by one member. In this case, the slider 60 configured by one member has two roles of a role of being connected with the bottom plate 43 and a role of holding the end fence 51.

When feeding the sheet P from the sheet tray 1 to the image forming device 20, the downstream end in the sheet feeding direction of the bottom plate 43 is raised. In the present embodiment, when the sheet tray 1 is inserted into the apparatus body of the image forming apparatus 100, the securement of the bottom plate locking member 403 that secures the bottom plate 43 in the state where the downstream end in the sheet feeding direction of the bottom plate 43 has completely lowered is released by a securement release mechanism, so that the downstream end in the sheet feeding direction of the bottom plate 43 shifts to rise. In the present embodiment, the mechanism in which the locking member lower protrusion 403*e* abuts against the downstream end in the sheet feeding direction of the tray supporting portion 215 and the bottom plate locking member 403 rotates composes the securement release mechanism.

When the bottom plate 43 rotates to raise the downstream end in the sheet feeding direction of the bottom plate 43, the connecting claw 44 as the connecting portion on the bottom plate 43 side moves to the downstream side in the sheet feeding direction (the right side in FIGS. 22 and 23). At this time, the slider 60 does not move until the claw-side contact portion 44*c* comes into contact with the slider-side contact portion 60*c*. When the claw-side contact portion 44*c* comes into contact with the slider-side contact portion 60*c* by the rotation of the bottom plate 43 and the bottom plate 43 further rotates, the slider 60 moves to the downstream side in the sheet feeding direction in conjunction with the rotation of the bottom plate 43. At this time, the end fence 51 secured to the slider 60 also moves to the downstream side in the sheet feeding direction.

As described above, in the state illustrated in FIGS. 22 and 23, the downstream gap w1 is formed between the claw-side contact portion 44*c* and the slider-side contact portion 60*c*. Therefore, when the bottom plate 43 begins to rotate, the claw-side contact portion 44*c* approaches the slider-side contact portion 60*c* to fill the downstream gap w1 Thereafter, the claw-side contact portion 44*c* comes into contact with the slider-side contact portion 60*c* and the bottom plate 43 further rotates, so that the force in the direction moving to the downstream side in the sheet feeding direction acts on the slider 60, and the slider 60 moves to be attracted by the bottom plate 43. By adjusting the size of the downstream gap w1 at a part level, a sliding amount of the slider 60 with the rotation of the bottom plate 43 to raise the downstream end in the sheet feeding direction can be adjusted, and the end fence 51 can be prevented from approaching the front wall 32 more than required. Thereby, the sheet P stored in the tray housing 30 can be prevented from being caught between the front end wall surface 32*f* of the front wall 32 and the end fence 51.

Therefore, the downstream gap w1 needs to be managed. When the thickness of the bottom plate 43 is set to 1 [mm], for example, the width in the sheet feeding direction of the connecting claw 44*b* to be inserted into the connecting hole 61*b* becomes 1 [mm] as is. The variation of parts is at most at the level of 1 [mm]. As the size of the downstream gap w1 set in the present embodiment, a gap amount larger than the variation of parts is secured.

As described above, FIGS. 5, 7, and 9 illustrate the sheet tray 1 in the extended state where the rear housing 50 is moved to the upstream side in the sheet feeding direction with respect to the front housing 40. In the present embodiment, since the fence holding slider 80 can be moved in the sheet feeding direction with respect to the connecting slider 90, the position of the end fence 51 can be moved to the upstream side in the sheet feeding direction in accordance with the extension of the sheet tray 1.

In the present embodiment, the fence holding slider 80 is pulled to the upstream side in the sheet feeding direction in the state where the securement release buttons 81*a* and 81*b* of the slider 60 in the non-extended state are being pressed, so that the fence holding slider 80 moves with respect to the connecting slider 90, resulting in the extended state. As the configuration to extend the slider 60, a configuration to release the securement of the fence holding slider 80 relative to the connecting slider 90 by a lever may be adopted. Further, a configuration in which the fence holding slider 80 automatically follows an extension operation of the tray housing 30 and moves from the non-extended state to the extended state may be adopted.

In the slider 60 of the present embodiment, the fence holding slider 80 is movable in the sheet feeding direction with respect to the connecting slider 90 connected to the bottom plate 43. Therefore, the connecting slider 90 and the bottom plate do not change in position by the extension, and a moving amount of the end fence 51 to the downstream side in the sheet feeding direction with the rotation of the bottom plate 43 does not change.

The sheet tray 1 includes the tray housing 30 in which the sheet P is set, and the tray housing 30 includes the front wall 32 and the rear wall 31. Further, the sheet tray 1 includes the bottom plate 43 rotatable about the bottom plate rotation shafts 431*a* and 431*b* with respect to the tray housing 30, and the slider 60 movable in the sheet feeding direction in the tray housing 30. The slider 60 includes the end fence 51 movable in the direction in which the slider 60 is movable (the sheet feeding direction) and secured at an arbitrary position within the movable range. The slider 60 has the connecting hole 61*b* as the connecting portion to be connected with the connecting claw 44*b* as a part of the bottom plate 43. When setting the sheet P, the position of the bottom plate 43 is secured in the state where the downstream end in the sheet feeding direction of the bottom plate 43 has completely lowered. When mounting the sheet tray 1 to the apparatus body of the image forming apparatus 100, the downstream end of the bottom plate 43, which is an end portion opposite to the connecting claw 44 in the sheet feeding direction, rises, and the sheet P in the sheet tray 1 is fed to the image forming device 20 in the raised state.

The length in the sheet feeding direction of the connecting hole 61*b* provided in the slider 60 is a length that allows formation of a gap between the upstream side and the downstream side in the sheet feeding direction across the connecting claw 44*b* between the edge of the connecting hole 61*b* and the connecting claw 44*b*. The slider abutting rib 84 in the upstream end in the sheet feeding direction, which is an end portion opposite to the side provided with the connecting hole 61*b* in the sheet feeding direction of the slider 60 comes into contact with the rear end wall surface 31*f* of the rear wall 31 to perform positioning when the sheet P is set. The slider 60 is biased in the direction of the rear wall 31 with respect to the tray housing 30 by the slider biasing spring 62, and the rear wall 31 and the slider 60 come into contact with each other at the time of setting the sheet P.

With such a configuration, even when the end fence 51 is set against the sheet P at the time of setting the sheet, the end fence 51 can be prevented from pushing the sheet P to the downstream side in the sheet feeding direction more than required by the rotation of the bottom plate 43 to raise the downstream end in the sheet feeding direction. Therefore, occurrence of a phenomenon in which the sheet P is not lifted when the sheet P is caught between the end fence 51 and the front wall 32 and the upstream end in the sheet feeding direction of the bottom plate 43 rises can be prevented.

The slider 60 includes the connecting slider 90 and the fence holding slider 80 slidable in the sheet feeding direction with respect to the connecting slider 90. Connection with the bottom plate 43 is performed by the connecting hole 61*b* as the connecting portion of the connecting slider 90, and the fence holding slider 80 does not have a connection portion with the bottom plate 43 and slides on the connecting slider 90. The end fence 51 slides on the fence holding slider 80.

The tray housing 30 can be divided into the front and rear two housings of the front housing 40 and the rear housing 50, the rear housing 50 includes the rear wall 31, and the rear housing 50 moves in the upstream side in the sheet feeding direction with respect to the front housing 40, whereby the rear wall 31 moved to the upstream side in the sheet feeding direction. The sheet tray 1 includes a housing securing member 56*d* to secure the rear housing 50 to the front housing 40 in each of the non-extended state and the extended state. By operating the extension lever 56 to release the securement by the housing securing member 56*d*, the rear housing 50 becomes movable with respect to the front housing 40. Then, even when the tray housing 30 is either in the extended state or in the non-extended state, the fence holding slider 80 comes into contact with the rear wall 31 and can be positioned. With the configuration, the sheet P (legal-size sheet) longer than the maximum sheet P (A4 sheet) settable in the tray housing 30 in the non-extended state can be set to the tray housing 30 and used.

In the sheet tray 1, the downstream gap w1 is equal to or larger than 1 [mm] in the state where the downstream end in the sheet feeding direction of the bottom plate 43 has completely lowered. With the configuration, the moving amount in the sheet feeding direction of the slider 60 when the bottom plate 43 rotates to raise the downstream end in the sheet feeding direction of the bottom plate 43 can be adjusted.

In the sheet tray 1 of the present embodiment, when the bottom plate 43 is pushed up by the bottom plate ascending springs 70 (i.e., the bottom plate ascending springs 70*a* and 70*b*), the bottom plate 43 rotates to raise the downstream end in the sheet feeding direction of the bottom plate 43. The configuration to rotate the bottom plate 43 is not limited to the configuration using a biasing body like the bottom plate ascending springs 70 (i.e., the bottom plate ascending springs 70*a* and 70*b*). For example, any configuration can be adopted as long as the bottom plate 43 is rotatable about the bottom plate rotation shafts 431*a* and 431*b*, such as a configuration to push up the lower surface of the bottom plate 43 with a drive lever.

Further, as illustrated in FIGS. 4 to 9, and the like, in the sheet tray 1 of the present embodiment, the position of the connecting claw 44 in the sheet feeding direction is near the bottom plate rotation shafts 431*a* and 431*b*. With the configuration, the distance (a rotation radius of the connecting claw 44) from the bottom plate rotation shafts 431*a* and 431*b* to the connecting claw 44 as viewed in plane (X-Z plane) orthogonal to an axial direction of the bottom plate rotation shafts 431*a* and 431*b* can be set to be short, and the moving amount of the connecting claw 44 when the bottom plate 43 rotates can be made small. Further, since the connecting claw 44 is located in a vicinity vertically below the bottom plate rotation shafts 431*a* and 431*b* as viewed in plane (X-Z plane) orthogonal to the axial direction of the bottom plate rotation shafts 431*a* and 431*b*, the moving amount in the up-down direction to the moving amount in the horizontal direction of the connecting claw 44*b* when the bottom plate 43 rotates can be made small. Thereby, releasing of the connection by coming off of the connecting claw 44*b* from the connecting hole 61*b* of the slider 60 sliding in the horizontal direction can be prevented.

A sheet feeding device 200 as a sheet conveying device of the present embodiment includes the sheet tray 1 and the sheet feed roller 2. Since the state in which the sheet P stored in the sheet tray 1 is caught between the inner wall surface of the tray housing 30 and the end fence 51 can be prevented, the sheet P can be moved up and down according to the up-down movement of the bottom plate 43, and the position of the upper surface of the sheet P relative to the sheet feed roller 2 is stabilized. Thereby, stable sheet feeding is possible when the sheet feed roller 2 is rotated.

Further, the image forming apparatus 100 as an image forming apparatus of the present embodiment includes the image forming device 20 and the sheet feeding device 200. Since the sheet feeding device 200 can perform stable sheet feeding, timing to feed the sheet P to a transfer position is stabilized. Accordingly, the problems such as image positional deviation can be prevented, and stable image formation becomes possible.

The configurations according to the above-descried embodiments are not limited thereto. This disclosure can achieve the following aspects effectively.

Aspect 1

A sheet container such as the sheet tray 1 includes a rotatable bottom plate such as the bottom plate 43 having a bottom plate-side contact portion such as the claw-side contact portion 44*c*, a regulating body such as the end fence 51 to regulate a position of a trailing end of a sheet such as the trailing end of the sheet P, and a holding body such as the slider 60 having a holding body-side contact portion such as the slider-side contact portion 60*c* and to hold the regulating body, in which a gap such as the downstream gap w1 is provided between the bottom plate-side contact portion and the holding body-side contact portion in a state where the bottom plate does not rotate, and the bottom plate-side contact portion and the holding body-side contact portion come into contact with each other as the bottom plate rotates, and the holding body moves to a downstream side in a sheet feeding direction such as the downstream side in the sheet feeding direction in conjunction with the rotation of the bottom plate. According to Aspect 1 when the bottom plate begins to rotate, the bottom plate-side contact portion moves to the downstream side in the sheet feeding direction to fill the gap between the bottom plate-side contact portion and the holding body-side contact portion, as described in the above embodiment. After the gap is filled and the bottom plate-side contact portion comes into contact with the holding body-side contact portion, the bottom plate further rotates, so that the bottom plate-side contact portion pushes the holding body-side contact portion, and the holding body moves to the downstream side in the sheet feeding direction in conjunction with the rotation of the bottom plate. When the holding body moves in conjunction with the rotation of the bottom plate, the regulating body held by the holding body also moves to the downstream side in the sheet feeding direction. When storing the sheet, a leading end of the sheet is brought to abut against a downstream-side inner wall surface (hereinafter referred to as "downstream inner wall surface") in the sheet feeding direction of the housing to store a sheet, and the trailing end of the sheet is brought to abut against the regulating body, in a state where the bottom plate does not rotate. Therefore, the distance from the regulating body to the downstream inner wall surface when storing the sheet is substantially the same as the length of the sheet in the feeding direction. After the sheet is stored, when the bottom plate rotates to raise a downstream end in the sheet feeding direction of the bottom plate, and the holding body moves to the downstream side in the sheet feeding direction in conjunction with the rotation and the distance from the regulating body to the downstream inner wall surface is narrowed, this distance becomes shorter than the length of the sheet in the feeding direction. In this state, the sheet is caught between the regulating body and the downstream inner wall surface and elastically deformed, and is stretched between the regulating body and the downstream inner wall surface due to the strength of the sheet. When the sheet is in the stretched state, even if the bottom plate rotates to raise the downstream end in the sheet feeding direction of the bottom plate to push up the leading end of the sheet, the bottom plate may not be able to push up the leading end of the sheet due to the stretching force of the sheet. In such a case, the leading end of the sheet supported by the bottom plate cannot be raised to a feedable position by a feeder, and feeding failure occurs. In Aspect 1, the holding body does not move until the gap is filled after the bottom plate begins to rotate to raise the downstream end in the sheet feeding direction in the bottom plate. When the gap is filled, the holding body moves to the downstream side in the sheet feeding direction in conjunction with the rotation of the bottom plate. Thereby, a moving amount of the regulating body to the downstream side in the feeding direction when the bottom plate rotates can be made small, and an increase in a narrowing amount of the distance from the regulating body to the downstream inner wall surface by the rotation of the bottom plate can be prevented. Therefore, an increase in the stretching force of the sheet caught between the regulating body and the downstream inner wall surface can be suppressed, and the bottom plate failing to push up the leading end of the sheet can be suppressed. Therefore, occurrence of the feeding failure when feeding a sheet can be suppressed.

Aspect 2

In Aspect 1, a biasing body such as the slider biasing spring 62 to bias the holding body to an upstream side in the sheet feeding direction such as the upstream side in the sheet feeding direction with respect to a housing such as the tray housing 30 to store a sheet such as the sheet P is included.

According to Aspect 2, even if a force toward the upstream side in the sheet feeding direction acts on the regulating body, the holding body abuts against the abutted body such as the rear wall 31 or the bottom plate-side contact portion, as described in the above embodiment. Therefore, variation of a position of the regulating body with respect to the housing can be prevented, and the position of the sheet with an end portion regulated by the regulating body in the housing is stabilized.

Aspect 3

In Aspect 1 or Aspect 2, the gap falls within a range from 0.5 [mm] to 2.0 [mm], both inclusive. According to Aspect 3, the configuration in which the gap can be secured even when there is an assembly error, and the holding body does not move until the gap is filled even when the bottom plate rotates can be implemented, as described in the above embodiment.

Aspect 4

In any one of Aspects 1 through 3, the gap is formed at a position at a downstream side in the sheet feeding direction with respect to the bottom plate-side contact portion and at an upstream side in the sheet feeding direction with respect to the holding body-side contact portion. According to Aspect 4, the configuration in which the bottom plate-side contact portion and the holding body-side contact portion come into contact with each other as the bottom plate rotates, and the holding body moves to the downstream side in the sheet feeding direction in conjunction with the rotation of the bottom plate can be implemented, as described in the above embodiment.

Aspect 5

In any one of Aspects 1 through 4, an abutted body such as the rear wall 31 against which the holding body abuts and to regulate movement of the holding body to an upstream side in the sheet feeding direction is further included, in which, when the bottom plate rotates such that a downstream end in the sheet feeding direction lowers in the state where the holding body-side contact portion and the bottom plate-side contact portion are in contact with each other, a position of the holding body-side contact portion is regulated as the holding body is regulated by the abutted body before the downstream end in the sheet feeding direction completely lowers, and when the bottom plate further rotates such that the downstream end in the sheet feeding direction lowers, the bottom plate-side contact portion moves to the upstream side in the sheet feeding direction and the gap is formed. According to Aspect 5, the configuration in which the gap is formed between the bottom plate-side contact portion and the holding body-side contact portion in the state where the downstream end in the sheet feeding direction of the bottom plate has completely lowered can be implemented, as described in the above embodiment.

Aspect 6

A sheet container such as the sheet tray 1 includes a rotatable bottom plate such as the bottom plate 43, a regulating body such as the end fence 51 to regulate a position of a trailing end of a sheet, a holding body such as the slider 60 to hold the regulating body, and to move to a downstream side in a sheet feeding direction in conjunction with rotation of the bottom plate, a biasing body such as the slider biasing spring 62 to bias the holding body to an upstream side in the sheet feeding direction such as the upstream side in the sheet feeding direction with respect to a housing such as the tray housing 30 to store a sheet such as the sheet P, and an abutted body such as the rear wall 31 against which the holding body abuts, and to regulate movement of the holding body to the upstream side in the sheet feeding direction, in which the holding body is biased by the biasing body and abuts against the abutted body in a state where the bottom plate does not rotate. According to Aspect 6, when storing the sheet, the position of the regulating body held by the holding body is stabilized, and the sheet with the trailing end of the sheet regulated by the regulating body can be easily stored in the sheet container, as described in the above embodiment.

Aspect 7

In Aspect 5 or Aspect 6, the abutted body is a wall portion (the rear wall 31 or the like) on the upstream side in the sheet feeding direction of the housing to store a sheet. According to Aspect 7, reduction of the number of parts and downsizing of the apparatus can be achieved as compared with a configuration in which the abutted body against which the holding body abuts is separately provided, as described in the above embodiment.

Aspect 8

In any one of Aspects 1 through 7, the housing to store a sheet includes a downstream housing such as the front housing 40 forming a portion on the downstream side in the sheet feeding direction, an upstream housing such as the rear housing 50 forming a portion on an upstream side in the sheet feeding direction and movable along the sheet feeding direction with respect to the downstream housing, and a housing securing body such as the housing securing member 56*d* to secure the upstream housing to the downstream housing, in which the holding body includes a bottom plate connecting body such as the connecting slider 90 having a connecting portion such as the connecting holes 61*a* and 61*b* to be connected with the bottom plate, a regulation moving body such as the fence holding slider 80 having a holding portion such as the rail groove 110 and the fence securing rack gear 250 to hold the regulating body and movable in the sheet feeding direction with respect to the bottom plate connecting body, and a holding body securing device such as the non-extended state securing protrusions 85*a* and 85*b*, the non-extended state securing recesses 95*a* and 95*b*, the non-extended state positioning lower protrusions 82*a* and 82*b*, the extended state positioning ribs 86*a* and 86*b*, the extended state positioning claws 96*a* and 96*b*, the extended state positioning lower protrusions 83*a* and 83*b*, and the positioning upper protrusions 93*a* and 93*b* to secure the regulation moving body to the bottom plate connecting body. According to Aspect 8, the distance in the sheet feeding direction from the holding body-side contact portion to the regulating body can be changed in accordance with change of the length in the sheet feeding direction of the housing to store a sheet, as described in the above embodiment. Thereby, the position of the regulating body can be changed according to the length in the sheet feeding direction of the housing to store a sheet, and the regulating body can abut against the trailing end of the sheet.

Aspect 9

A sheet conveying device such as the sheet feeding device 200 includes a container to store a sheet such as the sheet P, and a feeder such as the sheet feed roller 2 to feed the sheet stored in the container, in which a sheet container such as the sheet tray 1 according to any one of Aspects 1 through 8 is included as the container. According to Aspect 9, stable feeding becomes possible when feeding sheet by the feeder, as described in the above embodiment.

Aspect 10

An image forming apparatus such as the image forming apparatus 100 includes an image forming device (for example, the image forming device 20) to form an image on a sheet recording medium such as the sheet P, and a recording medium feeder to feed the recording medium toward the image forming device, in which a sheet conveying device such as the sheet feeding device 200 according to Aspect 9 is included as the recording medium feeder. According to Aspect 10, a problem such as image positional deviation can be prevented, and stable image formation becomes possible, as described in the above embodiment.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet container comprising:

a bottom plate disposed movable and having a bottom plate-side contact portion;

a regulating body configured to regulate a position of a trailing end of a sheet; and a holding body configured to hold the regulating body, the holding body including a holding body-side contact portion, a bottom plate connecting body having a connecting portion to be connected with the bottom plate, a regulation moving body having a holding portion to hold the regulating body and movable in a sheet feeding direction with respect to the bottom plate connecting body, and a holding body securing device to secure the regulation moving body to the bottom plate connecting body; and a container housing configured to contain the sheet, the container housing including a downstream housing forming a portion on a downstream side in the sheet feeding direction, an upstream housing forming a portion on an upstream side in the sheet feeding direction and movable along the sheet feeding direction with respect to the downstream housing, and a housing securing body to secure the upstream housing to the downstream housing, wherein the bottom plate and the holding body have a gap between the bottom plate-side contact portion of the bottom plate and the holding body-side contact portion of the holding body in a state in which the bottom plate is not rotated, the bottom plate-side contact portion of the bottom plate and the holding body-side contact portion of the holding body come into contact with each other along with rotation of the bottom plate, and the holding body moves to the downstream side in the sheet feeding direction in conjunction with the rotation of the bottom plate.

2. The sheet container according to claim 1, further comprising:

a biasing body configured to bias the holding body to the upstream side in the sheet feeding direction with respect to the container housing.

3. The sheet container according to claim 1, wherein the gap falls within a range from 0.5 [mm] to 2.0 [mm].

4. The sheet container according to claim 1, wherein the gap is provided at a position at the downstream side in the sheet feeding direction with respect to the bottom plate-side contact portion and at an upstream side in the sheet feeding direction with respect to the holding body-side contact portion.

5. The sheet container according to claim 1, further comprising:

an abutted body against which the holding body abuts, the abutted body configured to regulate movement of the holding body to an upstream side in the sheet feeding direction, wherein, when the bottom plate rotates to cause a downstream end in the sheet feeding direction to lower while the holding body-side contact portion and the bottom plate-side contact portion are in contact with each other, a position of the holding body-side contact portion is regulated as the holding body is regulated by the abutted body before the downstream end in the sheet feeding direction completely lowers, and wherein, when the bottom plate further rotates to cause the downstream end in the sheet feeding direction to lower, the bottom plate-side contact portion moves to the upstream side in the sheet feeding direction and the gap is formed.

6. The sheet container according to claim 5, wherein the abutted body is a wall portion on the upstream side in the sheet feeding direction of the container housing.

7. A sheet conveying device comprising:

the sheet container according to claim 1, the sheet container configured to contain a sheet; and a sheet feeding body configured to feed the sheet contained in the sheet container.

8. An image forming apparatus comprising:

an image forming device configured to form an image on a sheet; and the sheet conveying device according to claim 7, the sheet conveying device configured to convey the sheet toward the image forming device.

9. A sheet container comprising:

a container housing configured to contain a sheet, the container housing including a downstream housing forming a portion on a downstream side in a sheet feeding direction, an upstream housing forming a portion on an upstream side in the sheet feeding direction and movable along the sheet feeding direction with respect to the downstream housing; and a housing securing body to secure the upstream housing to the downstream housing;

a bottom plate disposed rotatable;

a regulating body configured to regulate a position of a trailing end of the sheet;

a holding body configured to hold the regulating body, and to move to the downstream side in the sheet feeding direction in conjunction with rotation of the bottom plate, the holding body including a bottom plate connecting body having a connecting portion to be connected with the bottom plate, a regulation moving body having a holding portion to hold the regulating body and movable in the sheet feeding direction with respect to the bottom plate connecting body, and a holding body securing device to secure the regulation moving body to the bottom plate connecting body;

an abutted body configured to regulate the holding body to move to the upstream side in the sheet feeding direction; and a biasing body configured to bias the holding body to the upstream side in the sheet feeding direction with respect to the container housing to abut against the abutted body when the bottom plate does not rotate.

10. The sheet container according to claim 9, wherein the abutted body is a wall portion on the upstream side in the sheet feeding direction of the container housing.

11. A sheet conveying device comprising:

the sheet container according to claim 9, the sheet container configured to contain a sheet; and a sheet feeding body configured to feed the sheet contained in the sheet container.

12. An image forming apparatus comprising:

an image forming device configured to form an image on a sheet; and the sheet conveying device according to claim 11, the sheet conveying device configured to convey the sheet toward the image forming device.

* * * * *